US006817059B2

(12) United States Patent
Tsuchiya et al.

(10) Patent No.: US 6,817,059 B2
(45) Date of Patent: Nov. 16, 2004

(54) VACUUM CLEANER

(75) Inventors: Norihiro Tsuchiya, Shiga (JP); Hiroshi Mori, Shiga (JP); Tomonori Kato, Shiga (JP); Hideo Okubo, Shiga (JP); Saburo Kajikawa, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 221 days.

(21) Appl. No.: 10/031,028

(22) PCT Filed: May 17, 2001

(86) PCT No.: PCT/JP01/04120

§ 371 (c)(1),
(2), (4) Date: May 7, 2002

(87) PCT Pub. No.: WO01/87130

PCT Pub. Date: Nov. 22, 2001

(65) Prior Publication Data

US 2002/0148070 A1 Oct. 17, 2002

(30) Foreign Application Priority Data

May 17, 2000 (JP) ..... 2000-145179
May 18, 2000 (JP) ..... 2000-146548
May 18, 2000 (JP) ..... 2000-146549

(51) Int. Cl.[7] ..... A47L 5/14; A47L 5/28

(52) U.S. Cl. ..... 15/352; 15/345; 15/DIG. 1; 55/429; 55/DIG. 3

(58) Field of Search ..... 15/319, 344, 345, 15/347, 351, 352, DIG. 1; 55/427, 429, DIG. 3

(56) References Cited

U.S. PATENT DOCUMENTS 1,829,582 A * 10/1931 Carson ..... 15/347
2,491,007 A * 12/1949 Koch ..... 69/20
4,257,789 A * 3/1981 Leinfelt ..... 55/378
4,276,070 A * 6/1981 Hug ..... 55/429
4,835,409 A * 5/1989 Bhagwat et al. ..... 307/64
5,500,979 A * 3/1996 Worwag ..... 15/349
5,551,119 A * 9/1996 Worwag ..... 15/319
5,664,285 A 9/1997 Melito et al.
5,926,909 A * 7/1999 McGee ..... 15/339
6,209,168 B1 * 4/2001 Brickner et al. ..... 15/332
6,317,920 B1 * 11/2001 Brickner et al. ..... 15/334
6,345,411 B1 * 2/2002 Kato et al. ..... 15/412
6,442,792 B1 * 9/2002 Sudou et al. ..... 15/339

FOREIGN PATENT DOCUMENTS

| | | |
|---|---|---|
| GB | 2137896 | * 10/1984 |
| JP | 57-183942 | 11/1982 |
| JP | 1-207025 | * 8/1989 |
| JP | 2-189120 | * 7/1990 |
| JP | 07327888 | 12/1995 |
| JP | 09-192056 | 7/1997 |
| JP | 3067663 | 1/2000 |

OTHER PUBLICATIONS

Japanese International Search Report for PCT/JP01/04120 dated Aug. 28, 2001.

* cited by examiner

*Primary Examiner*—Terrence R. Till
(74) *Attorney, Agent, or Firm*—RatnerPrestia

(57) ABSTRACT

A vacuum cleaner includes working elements of cleaner, that is, a blower and a dust collection unit disposed in a nozzle section of which casing is composed of an upper unit and a lower unit, and having a handle coupled to the nozzle section. At least one of the working elements is supported by the upper unit and a support unit provided in the lower unit or by the lower unit and a support unit provided in the upper unit. Therefore, the cleaner can be repaired without having all screws removed, thus repaired conveniently.

7 Claims, 38 Drawing Sheets

(a)

(b)

VACUUM CLEANER

CROSS-RELATED APPLICATIONS

This Application is a U.S. National Phase Application of PCT International Application PCT/JP01/04 120.

TECHNICAL FIELD

The present invention relates to a vacuum cleaner, and more particularly to a vacuum cleaner being repaired easily and capable of informing a user of a collected dust level.

BACKGROUND ART

A conventional vacuum cleaner disclosed in Japanese Laid-open Patent No. 9-192056 has a configuration as shown in FIG. 34 and FIG. 35. Referring to the drawings, the configuration will be explained below.

As shown in the drawings, the vacuum cleaner includes a working element, i.e., a blower 201, a dust collection box unit 202 having a dust collection box 212 and a filter unit 213, and a rotary brush 203. The cleaner also includes a nozzle section 204 which accommodating the above parts and a handle 205 coupled to the nozzle section 204. A case of the nozzle section 204, being composed of an upper unit 206 and a lower unit 207, supports or holds the working element of the blower 201, the dust collection box unit 202, and the rotary brush 203. In this configuration, for being repaired or maintained, the inside of the cleaner cannot be checked unless all screws tightening the upper unit 206 and lower unit 207 of the nozzle section 204 are removed. Recently, moreover, in order to give a one-body impression of the design of the nozzle section 204 and upper unit 206, a division line between the units tends to be hidden.

A dust suction port 209 linking to the dust collection box unit 202 is provided at the center of the nozzle section 204, and dust particles are swept out from a floor with the rotary brush 203 and are sucked into the dust collecting box unit 202. A suction passage 210 from the blower 201 is provided at a belt side nearly from the center in the dust collection box unit 202. The dust particles swept out from the floor with the rotary brush 203 pass through the dust suction port 209, and get into the dust collection box unit 202. In this case, since a positional deviation between an exhaust port 211 and the dust suction port 209 of the dust collection box unit 202 is slight, the dust particles are collected at the center, and are hardly collected at the corners of the dust collection box unit 202. As a result, even if the dust collection box unit 202 is not filled with the dust particles, power of suction may be dropped.

A switch 214 is attached to the lower unit of the nozzle section 204, and is turned on and off with a pedal 215. The switch 214 is connected with a wire to a charger connection part 220 which connects the blower 201, a second motor 216 for driving the rotary brush 203, and a battery 218 to a charger.

The battery 218 and blower 201 are located at one side from the center in the nozzle section 204.

Exhaust from the blower 201 is released from an exhaust port 222 provided in the upper unit 206 of the nozzle section 204. The exhaust port 222 is provided with an exhaust filter 223 for removing dust particles from the exhaust.

In this configuration, however, if there occurs a trouble in the nozzle section 204, the inside of the nozzle section cannot be checked unless all screws tightening the nozzle section 204 are removed. And it hence takes much time and labor to check the inside through disassembling it.

Moreover, in an assembling process, since the switch 214 and the charger connection part 220 are far from each other, a lead wire 221 needs to be long, thus making the cleaner be hardly assembled.

Besides, since the blower 201 and battery 218 are placed upper and lower at the same position, the center of gravity of the nozzle section 204 is shifted to one side of the section, and the cleaner is hardly carried and used.

Further, since this cleaner has no mechanism for locking the nozzle section 204 with the handle 205 when being carried, upon the cleaner having the handle 205 lifted, the nozzle section 204 droops down. Therefore, when carrying the cleaner, a user must lift the nozzle section 204 with holding a portion of the depth of the section, with not holding a slight portion, and thus, can hardly carry the cleaner. To the contrary, if the cleaner is designed to have the nozzle section 204 and handle 205 locked, it is necessary to unlock by stepping on the nozzle section 204 although the holding force of lock is sufficient, and the cleaner can thus hardly be used.

Further, exhaust is not released to outside of the vacuum cleaner recently, but in this configuration, the exhaust is discharged outside, and is not good for environments.

The configuration of the dust collection box unit 202 installed in a central recess of the nozzle section 204, from the aspect of design, requires the handle of the dust collection box unit 202 formed in the center This sacrifices a dust collection capacity of the dust collection box unit 202. And further, the upward opening makes a portion around the opening hollow and weak structurally.

The cleaner is packaged as a completed product with the handle 205 attached, but tends to be packaged smaller and lighter recently, and the package size is thus required to reduce. When repairing the cleaner, since the handle 205 is not locked, an operator must lower his/her waist for putting the product horizontally, and can hardly work.

The switch 214 can be turned on and off by stepping on the pedal 215, but may be hardly used with the foot or stepped by a lefty.

Since the second motor 216 is used for rotating the rotary brush 203, the cleaner has an increased weight, and this is out of a recent trend of a small size and light weight.

Dust is collected only at the suction path by the blower 201 in the dust collection box unit 202 which is exposed to suction by the blower 201, and dust does not gather in the end portion of the unit.

For being installed in a recess 224 of the nozzle section 204, the dust collection box unit 202 is not prevented sufficiently from being inserted in wrong direction.

The dust suction port 209, which is provided in the center of the nozzle section 204 has bristles of which direction does not match to the rotation direction of the rotary brush 203. This decreases a dust collection performance.

Since an intake port 225 of the dust collection box unit 202 is made of soft material, when being installed in the recess 224 of the nozzle section 204, the dust collection box unit 202 receives an excessive fitting stress and may thus deform in order to be fit tightly.

The dust collection box unit 202 is held and fixed at a ratchet holder 226 provided at a side of the bottom of the recess 224 of the nozzle section 204. In this case, dust may leak from the dust collection box unit 202 and may be collected in the ratchet holder 226, and may make the holder 226 fail to function.

Since the dust collection box unit 202 is inserted into the recess 224 of the nozzle section 204 from above, a detaching handle 227 of the dust collection box unit 202 must be provided in the center of the dust collection box unit 202. This decreases the dust collection capacity and makes the appearance poor.

The dust collection box unit 202 installed in the central recess of the nozzle section 204 requires the opening made upward and makes the strength weaker.

Another conventional vacuum cleaner disclosed in Japanese Patent Application No.10-302461 has a configuration as shown in FIG. 36 to FIG. 38. The configuration will be explained below while referring to the drawings.

As shown in FIG. 36 to FIG. 38, a battery 233 and a blower 234 driven by it are accommodated in a cleaner main body 231. Behind the cleaner main body 231, a dust collector 231*b* is provided at a suction side of the blower 234. Ahead of the cleaner main body 231, a suction unit 231*a* is provided, and a lower side of the suction unit 231*a* has a suction port for leading dust from a cleaning surface into the suction unit 231*a*. The suction unit 231*a* and the dust collector 231*b* are communicated through a communicating path. At a lower side behind the cleaner main body 231, a terminal connection unit 235 for charging is disposed. A lower side of the terminal connection unit 235 has a concave shape, and a terminal 235*a* is fitted in this concave inner wall. At a rear end of the cleaner main body 231, a traveling roller 246 projecting from the lower side and rear side of the cleaner main body 231 is provided. A charger 237 is composed of a box unit 238, a coupling unit 241 extending forward from the lower-front end of the box unit 238, and a terminal unit 239 for charging provided on the coupling unit 241 at the front side of the box unit 238 which is inserted into a recess of the terminal connection unit 235 of the cleaner main body 231. Near the terminal unit 239 in the box unit 238, a power source transformer 240 for charging is incorporated. With having the terminal connection unit 235 receive the terminal unit 239 of the charger 237 inserted thereto and with having mutual terminals connected to each other, the cleaner main body 231 is installed horizontally on the charger 237 to be connected electrically, so that the battery 233 in the cleaner main body 231 may be charged. A power cable 242 is inserted into an ordinary wall outlet.

In such conventional configuration, however, as shown in FIG. 37, the transformer 240, printed circuit boards, and other electrical parts are disposed inside. The charger 237 is formed in a box shape with the terminal unit 239 for charging to be inserted into the terminal connection unit 235 of the cleaner main body 231. The charger 237 and the terminal connection unit 235 for charging of the cleaner main body 231 are fitted and installed horizontally. In this case, the cleaner main body 231 and the charger 237 are stored in a tandem layout, and the storing space is large. When the charger 237 is mounted on the cleaner main body 231, the terminal connection unit 235 provided beneath the cleaner main body 231 and the terminal unit 239 of the charger 237 placed on a floor must be connected by inserting convex and concave ribs exactly from above. This makes the cleaner be hardly used.

SUMMARY OF THE INVENTION

The invention is to solve above problems, and a first object thereof is to allow a cleaner to be repaired easily, to inform a user of a dust collection level, and to be used easily.

A second object is to allow a cleaner to be charged and stored in a compact space for being used easily.

To achieve the first object, the invention presents a cleaner including working elements of the cleaner, that is, a blower and a dust collection box unit, both disposed in a nozzle section, and a handle coupled to the nozzle section. A case of the nozzle section is composed of an upper unit and a lower unit. And at least one of the working elements is supported by the upper unit and other member disposed at the lower unit or by the lower unit and other member disposed at the upper unit.

As a result, the cleaner can be repaired without having all screws removed, and thus, can be repaired easily.

The dust collection box unit communicating with a suction side of the blower for collecting dust is composed of a dust collection box and a filter unit detachably fitted to the dust collection box. Intake air through the dust collection box unit flows nearly in parallel with a surface of the filter unit.

Accordingly, dust particles are collected in the dust collection box unit sequentially from the inner side of the dust collection box unit, and a user can visually recognize a dust collection level, and thus, the cleaner can be used easily.

To achieve the second object, the vacuum cleaner includes a cleaner main body having a terminal connection unit for charging, and a charger of a box shape formed separately. And a terminal unit for charging is provided at a coupling surface of the box shape, and the cleaner main body is mounted on the coupling surface.

As a result, instead of a tandem layout, the charger of the box shape can be placed in parallel with the cleaner main body, and a floor contact area occupied by the cleaner main body and the charger overlaying on the body when the body is stored. This provides the cleaner with no obstacle when being stored, and is used easily.

BRIEF DESCRIPTION OF THE DRAWINGS

FIG. 31(*b*) is a partially cutout front view of the charger of the vacuum cleaner.

FIG. 31(*c*) is a partially cut-out top view of the charger of the vacuum cleaner.

FIG. 37(*b*) is a top view of the charger of the vacuum cleaner.

FIG. 37(*c*) is a side view of the charger of the vacuum cleaner.

FIG. 38(*b*) is a top view of the cleaner main body of the vacuum cleaner.

Figure 1:
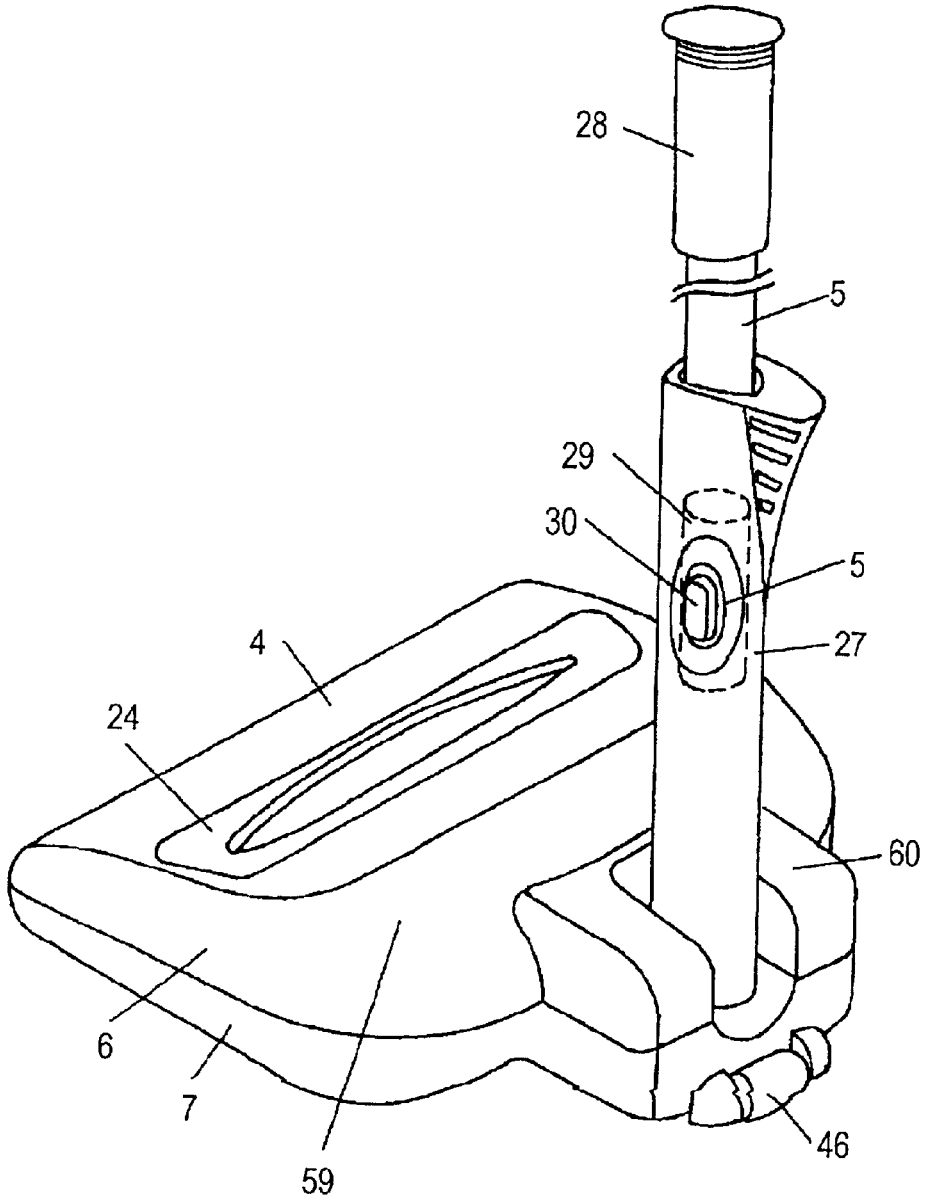
FIG. 1 is a perspective view of a vacuum cleaner according to embodiment 1 of the present invention.

BRIEF DESCRIPTION OF THE PREFERRED EMBODIMENT (Embodiment 1)

Referring to the drawings, embodiment 1 of the invention will be explained below.

As shown in FIG. 1 to FIG. 4, a nozzle section 4 includes a case composed of an upper unit 6, a lower unit 7, a window 24, a lid 25, a belt cover 26, and a support plate 64. The case incorporates a blower 1, a dust collection box unit 2, a rotary brush 3, a safety device 17, a switch 14, and a hand-holder 27. A handle 5 made of aluminum is detachably fitted to the hand-holder 27. The handle 5 includes three or four aluminum pipes combined together with one another. A grip 28 of the handle 5 is a position to be gripped by a user. In a center of a fitting body 29 of the handle 5 engaged with the hand-holder 27, an elastic ratchet 30 is provided and is engaged with a hole 31 in the hand-holder 27.

Figure 6:
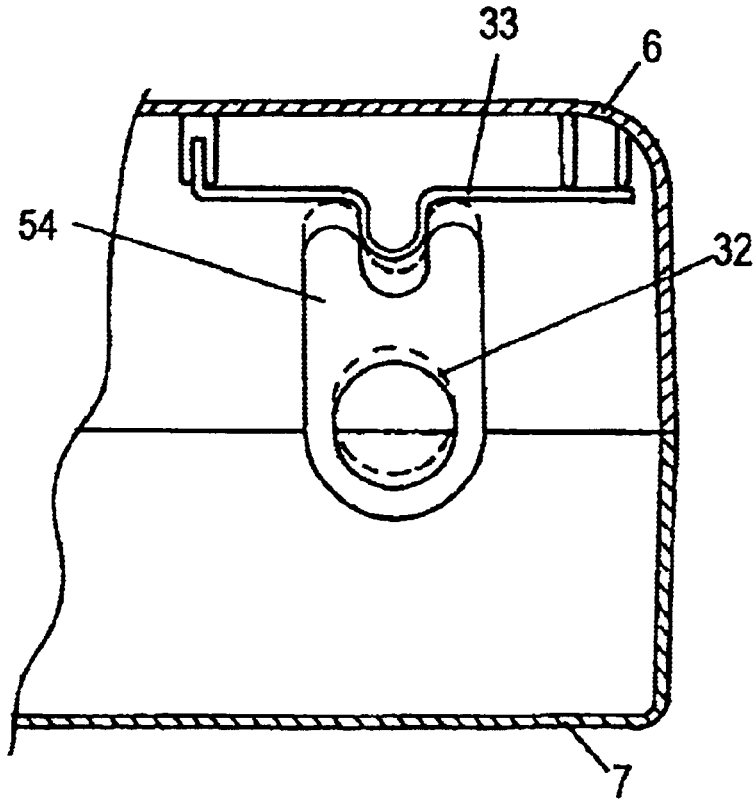
FIG. 6 is an essential sectional view of the vacuum cleaner.
Figure 7:
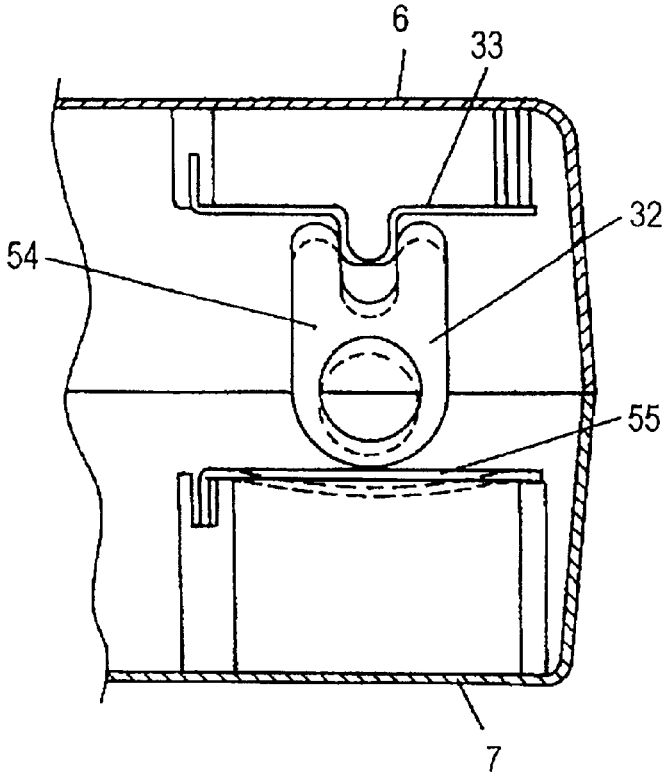
FIG. 7 is an essential sectional view of the vacuum cleaner.
Figure 8:
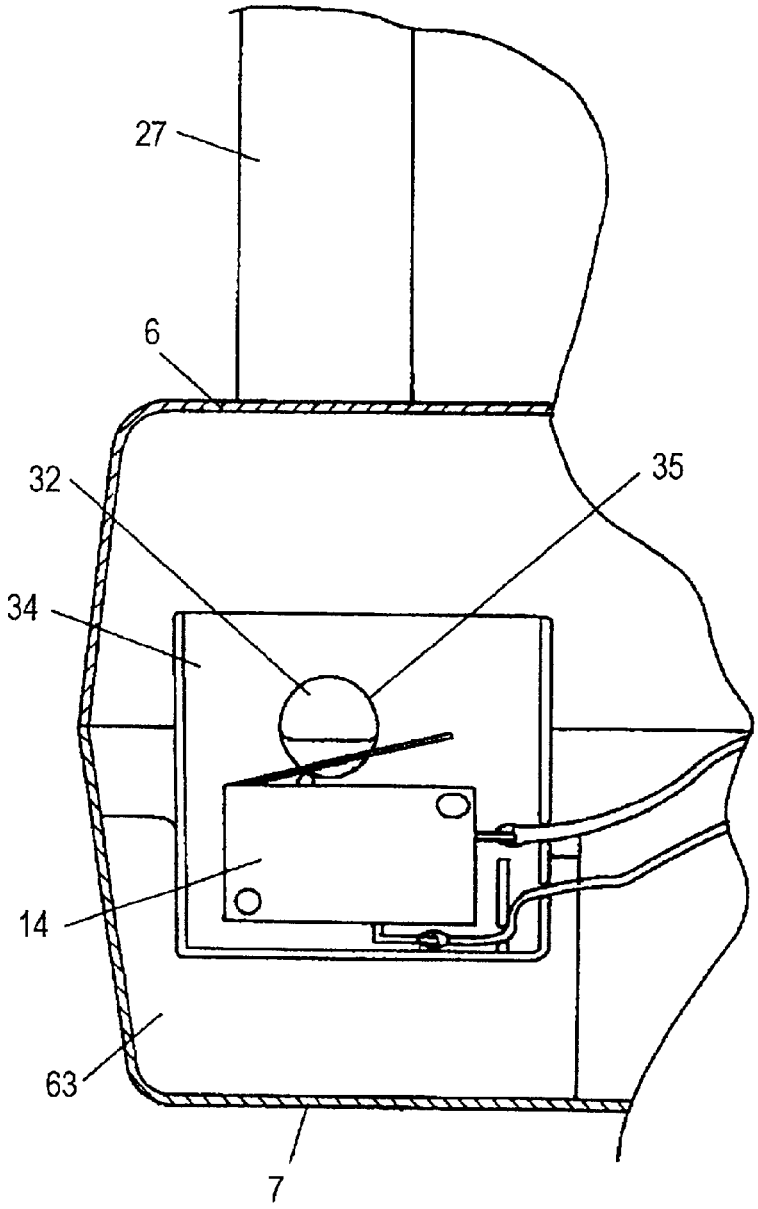
FIG. 8 is an essential sectional view of the vacuum cleaner.

One side of a rotary shaft 32 of the hand-holder 27 forms a foot to be fitted with a spring 33 in nearly U-shape as shown in FIG. 6 and FIG. 7. The switch 14 is fixed to a switch support plate 34 at the other side of the rotary shaft 32 as shown in FIG. 8, and the rotary shaft 32 is inserted in a hole 35 of the switch support plate 34.

In a rotary brush compartment 8, the rotary brush 3 is disposed, and the belt cover 26 is provided to cover a pulley 36. A fan 38 is press-fitted at one end of a shaft 37 of the blower 1, and a pulley 39 is attached to the other end of the shaft 37. The pulley 39 is linked to an intermediate pulley 40 with a belt 41, and the intermediate pulley 40 and a pulley 36 are linked with a belt 42.

A brush 44 is disposed at a front side of the nozzle section 4, and a brush 45 is disposed at a lower side of the center of the cleaner main body. A roller 46 is provided behind.

Figure 5:
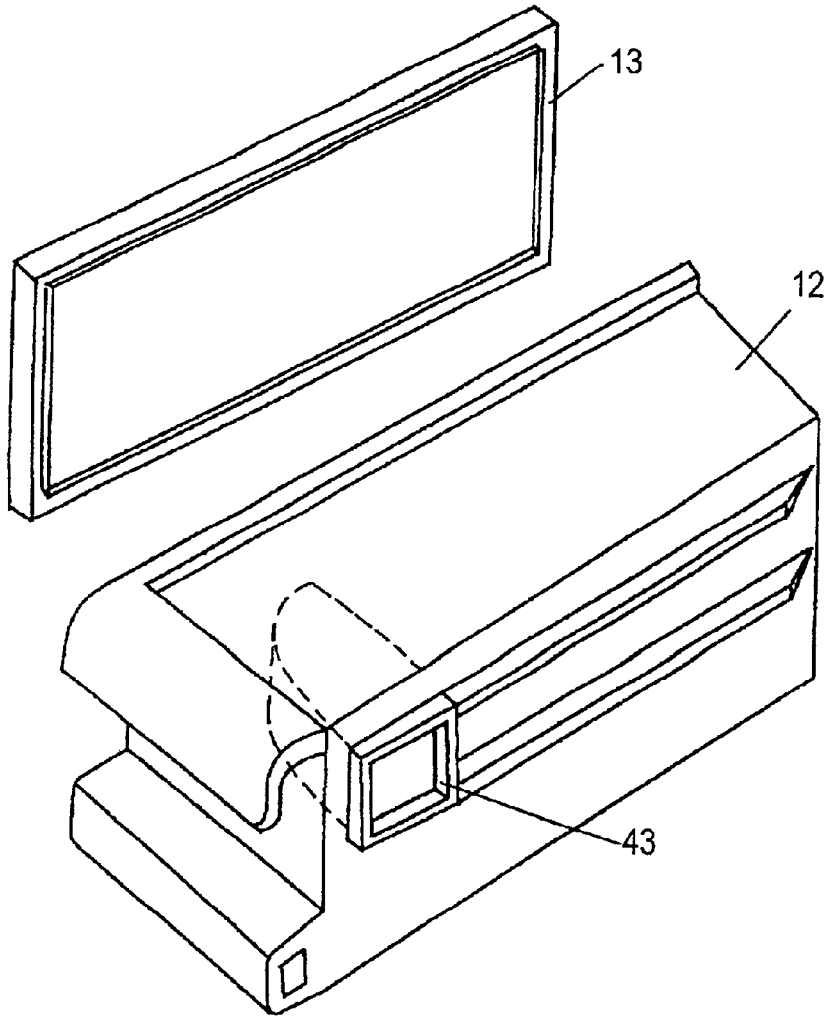
FIG. 5 is a perspective exploded view of a dust collection box of the vacuum cleaner.
Figure 9:
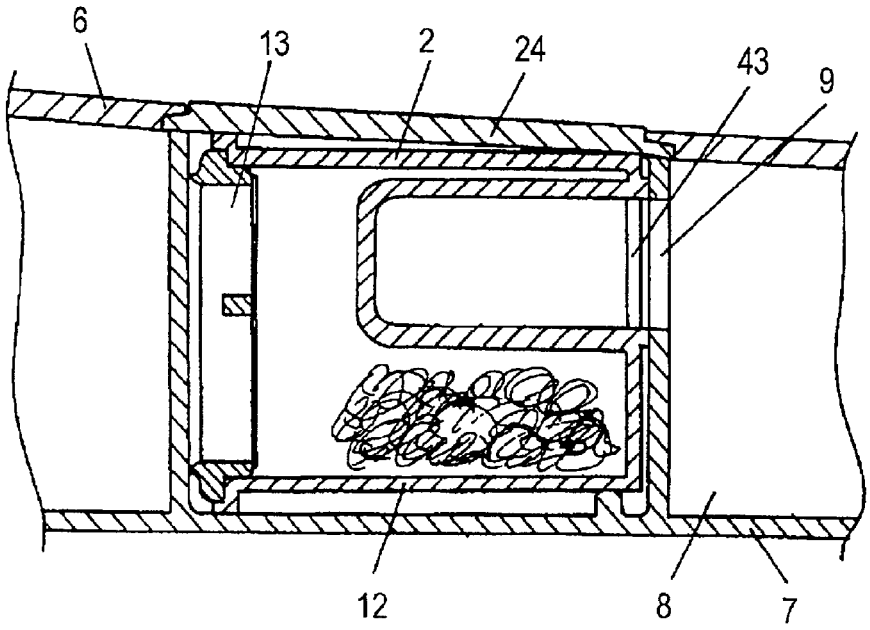
FIG. 9 is an essential sectional view of the vacuum cleaner.

The dust collection box unit 2 is composed of a dust collection box 12 and a filter unit 13 as shown in FIG. 5. An intake port 43 of the dust collection box 12 is enclosed with a rib and is matched, as shown in FIG. 9, with a surface of a dust suction port 9 of the rotary brush compartment 8, a suction compartment.

An operation of the vacuum cleaner having such configuration will be explained. The handle 5, upon being turned from a 90-degree upright position by a certain angle about the rotary shaft 32, turns on the switch 14. When the switch 14 is turned on, the blower 1 starts to rotate and makes the rotary brush 3 rotate accordingly through the intermediate pulley 40. Dust particles swept by the rotary brush 3 are sent into the dust collection box unit 2 from the dust suction port 9 through the intake port 43, and are collected in the dust collection box unit 2 without passing through the filter unit 13 provided at the outlet. The exhaust passing through the filter unit 13 passes through the filter 47 and passes further through the blower 1 and filter 48. Then, the exhaust is discharged into the rotary brush compartment 8. The handle 5, being returned to the original position, stops the operation.

The blower 1 is supported by the upper unit 6 and the support plate 64. And the dust collection box unit 2 is supported by the lower unit 7 and the window 24. The rotary brush 3 is supported by the upper unit 6 and the belt cover 26. That is, the blower 1, the dust collection box unit 2, and the rotary brush 3 are supported by the upper unit 6 and other member, or the lower unit 7 and other member.

In this configuration, when, for example, the blower 1 failing to operate is to be repaired, the support plate 64 supporting the blower 1 is removed, so that the blower 1 can be checked and repaired. Thus, the cleaner can be repaired easily without having all screws fixing the nozzle section 4 removed.

Moreover, since the upper unit 6, lower unit 7, support plate 64, window 24, and belt cover 26 are separated, each part may be composed to have its own feature. For example, the support plate 64 may be made of rigid material to enhance the supporting force. The window 24 and belt cover 26 may be made of transparent material so that a dust collection level or invasion of hairs in the belt cover 26 can be checked from outside.

When being inserted in and pulled out from a side of the nozzle section 4 like a drawer, the dust collection box unit 2 usually slides easily. But when the space between the dust collection box unit 2 and lower unit 7 is clogged with dust, the box unit can hardly be pulled out. In such case, removing the window 24 allows the dust collection box unit 2 to move, so that dust may be removed easily.

The rotary brush 3 is supported by the upper unit 6 and the belt cover 26. If the rotary brush 3 is clogged with hairs or large dust particles getting into a space between the rotary brush 3 and dust suction port 9, removing the belt cover 26 allows the rotary brush 3 to be removed, so that the hairs or large dust particles can be removed easily.

This configuration provides an easy-to-repair vacuum cleaner of high quality.

Dust particles swept by the rotary brush 3 are sent into the dust collection box unit 2 from the dust suction port 9 through the intake port 43, and collected in the dust collection box unit 2 without passing through the filter unit 13 provided at the outlet. Not having the exhaust hole for discharging the exhaust from the blower 1 to outside from the nozzle section 4, the cleaner allows the exhaust passing through the filter unit 13 to pass through the filter 47, and further to pass through the blower 1 and filter 48. Then, the exhaust is discharged into the rotary brush compartment 8. This exhaust circulation loop has a vacuum cleaner silent in operation and friendly to environments.

Figure 3:
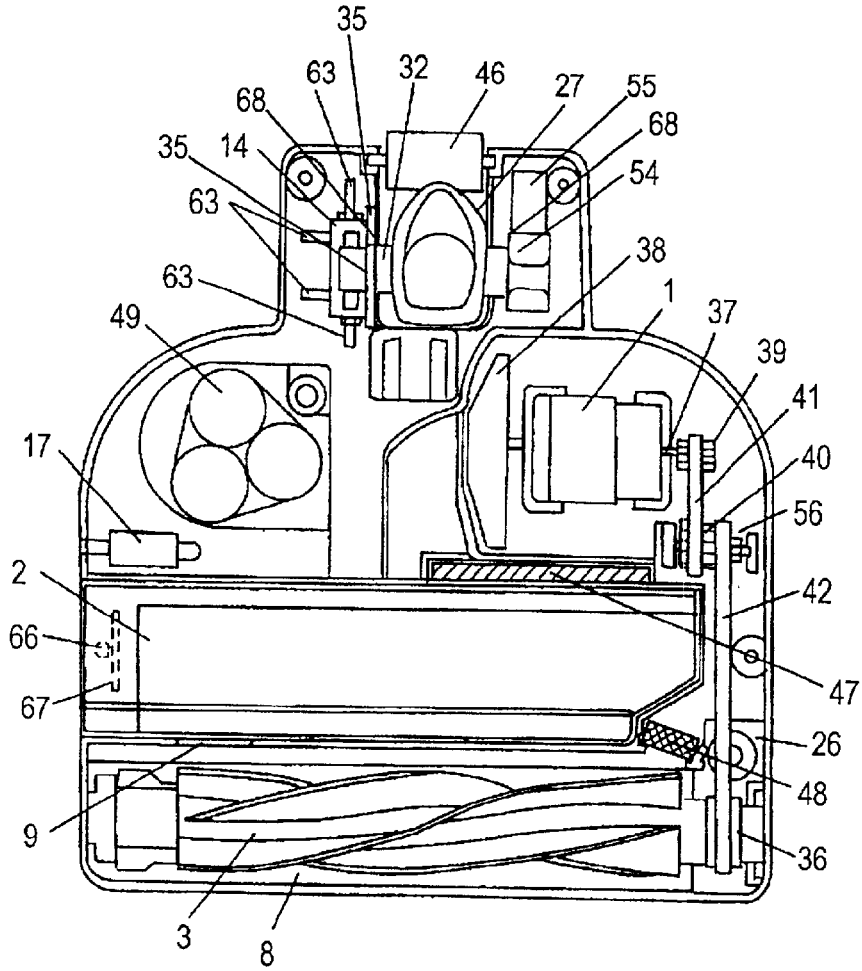
FIG. 3 is a horizontal cross sectional view of the vacuum cleaner.
Figure 4:
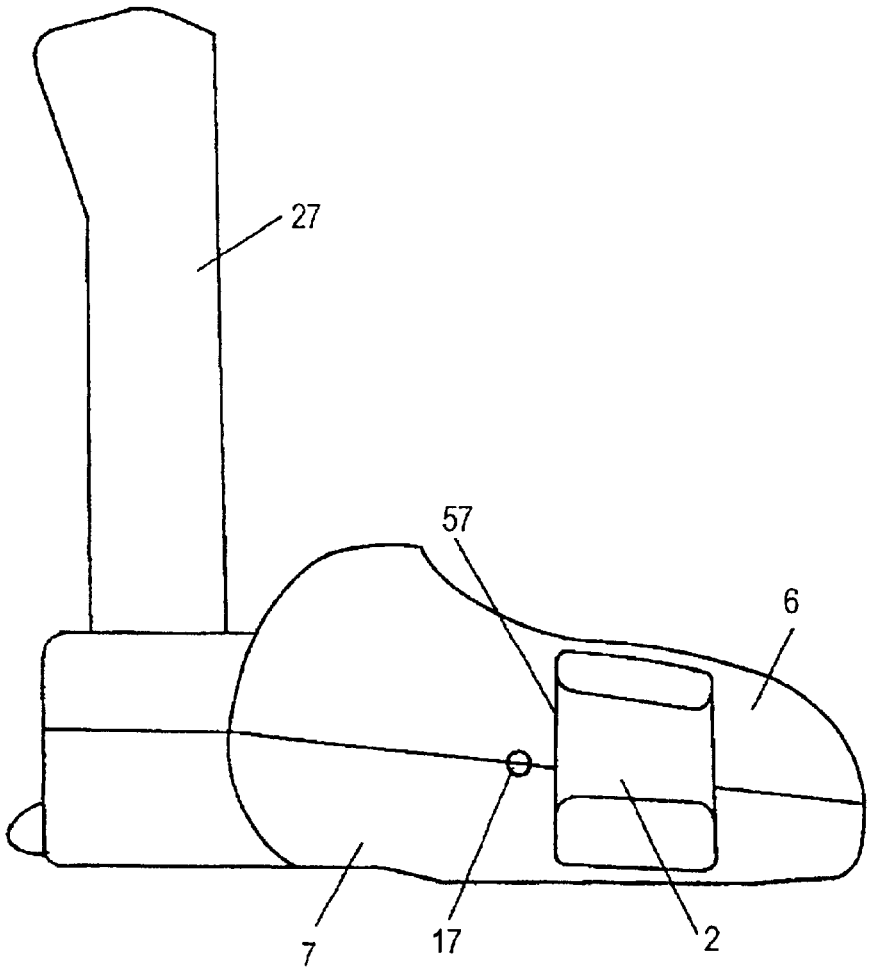
FIG. 4 is a side view of the vacuum cleaner.
Figure 10:
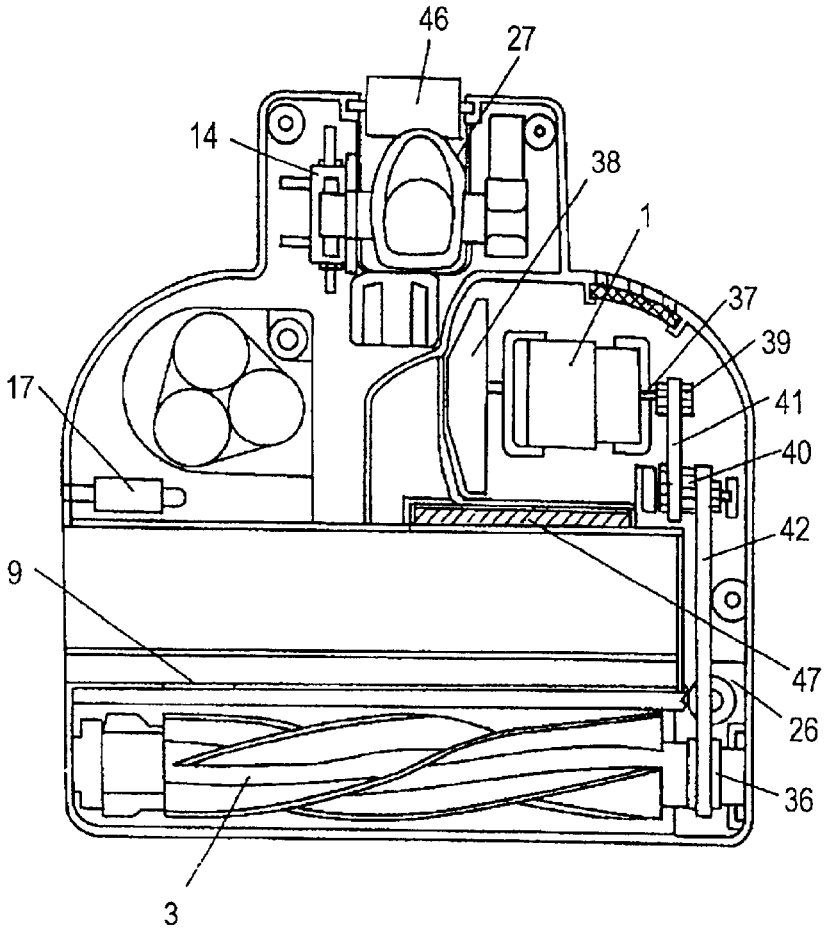
FIG. 10 is a horizontal cross sectional view of the vacuum cleaner.
Figure 11:
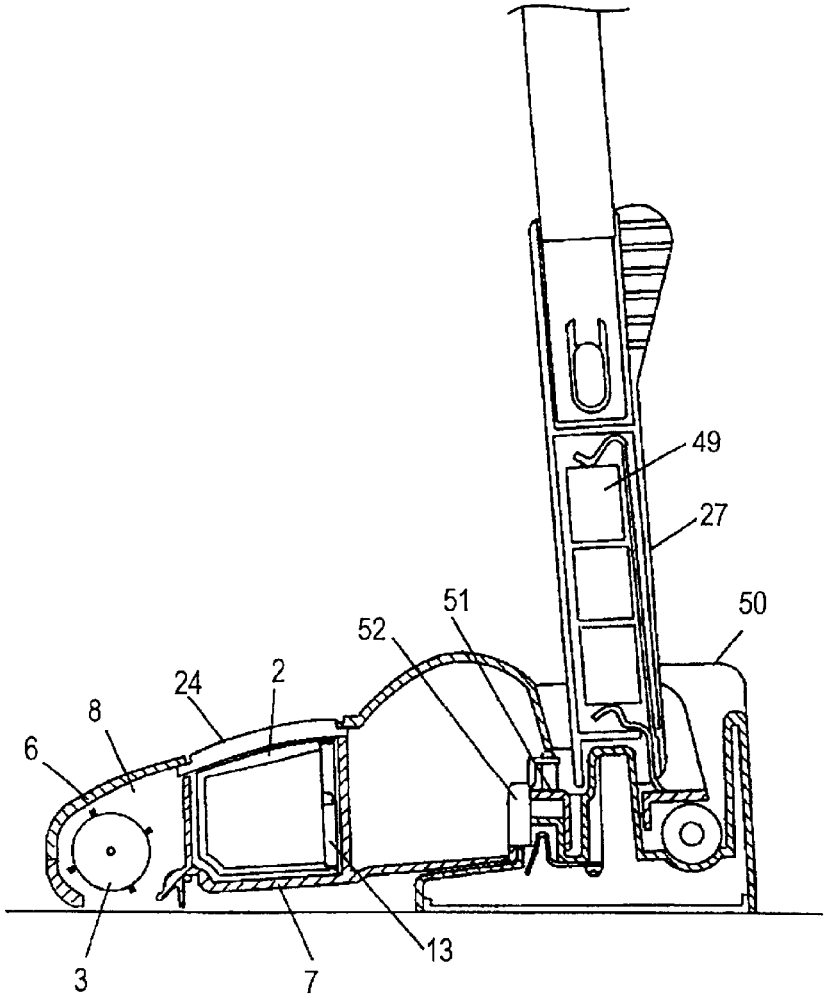
FIG. 11 is a sidecross sectional view of the vacuum cleaner.
Figure 12:
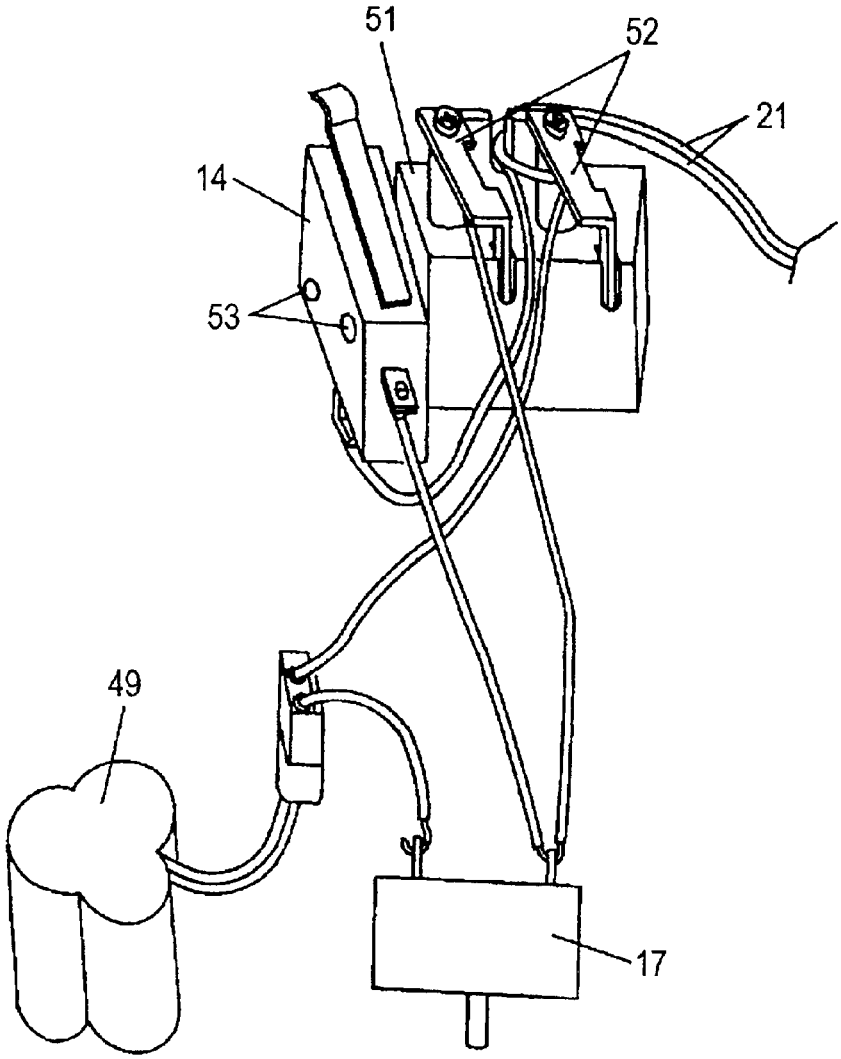
FIG. 12 is an essential perspective exploded view of the vacuum cleaner.

As shown in FIG. 3, FIG. 10, and FIG. 11, regardless of the presence of the exhaust circulation loop, the cleaner may includes a battery 49 in the nozzle section 4, in the hand-holder 27, or in both nozzle section 4 and hand-holder 27. This provides a cordless/easy-to-use vacuum cleaner.

Figure 2:
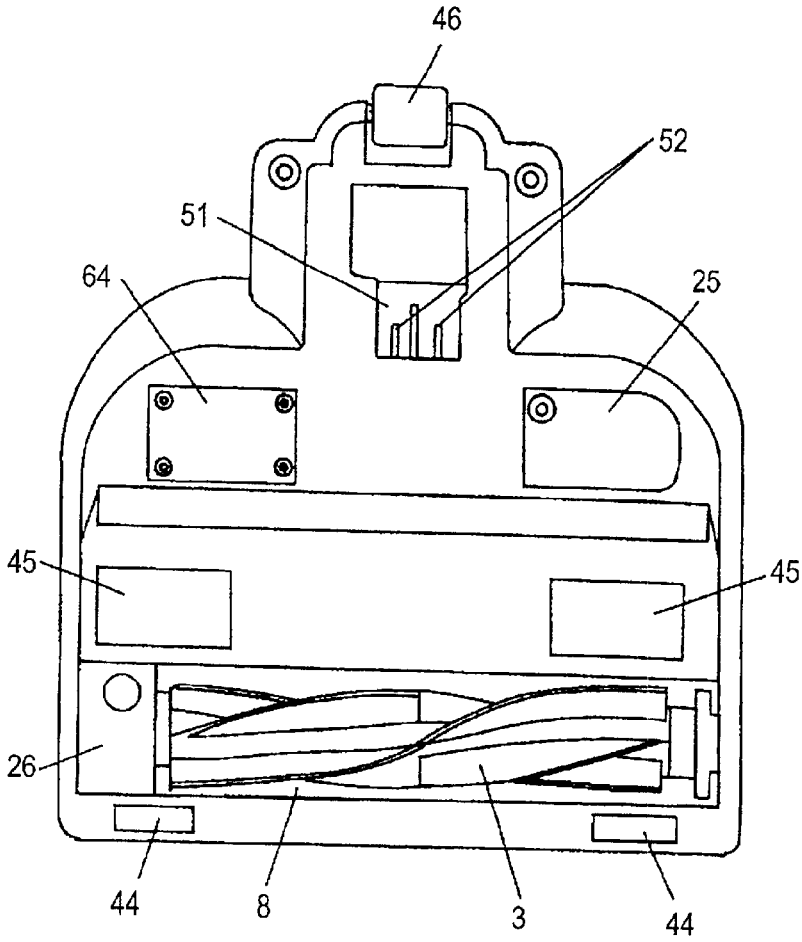
FIG. 2 is a bottom view of the vacuum cleaner.

As shown in FIG. 1 to FIG. 3, the rotary brush 3 is provided in the rotary brush compartment 8. The dust suction port 9 is provided in a wall of the rotary brush compartment 8 as shown in FIG. 9. The intake port 43 corresponding to the dust suction port 9 is formed in the dust collection box unit 2, and the dust suction port 9 is located at the opposite side of the pulley 36 of the rotary brush 3.

In this configuration, dust particles swept by the rotary brush 3 are collected in the dust collection box unit 2 from the dust suction port 9 through the intake port 43. Bristles of the rotary brush 3 are usually planted spirally, and, through a rotation of the rotary brush 3, guides the dust particles into the dust suction port 9. The dust suction port 9, if being provided near the pulley 36 of the rotary brush 3, allows dust particles to invade into the pulley 36 and makes teeth of the pulley clogged and broken. Thus, the dust particles possibly generate unusual noise, and therefore, the dust suction port 9 is provided at the opposite side of the pulley 36. When being carried and hitting a corner of furniture or the like, the cleaner main body has the nozzle section 4 unlocked and direct downward. In such case, in order that the dust collected in the bottom of the dust collection box unit 2 may not spill out through the dust suction port 9 from the intake port 43, the dust suction port 9 and the intake port 43 are provided at higher positions than the middle level of the unit 2.

This configuration provides a vacuum cleaner of high quality, hardly spilling dust, and easy to use.

Then, as shown in FIG. 1 to FIG. 3, FIG. 11, and FIG. 12, a charger connection unit 51 connected to a charger stand 50 holds and installs a charging terminal 52 and the switch 14 onto the lower unit 7 of the nozzle section 4. At this moment, the switch 14 has a hole fitted to a pin 53 projecting from the charger connection unit 51. The charger connection unit 51, being close to the lower unit 7 of the nozzle section 4, prevents the switch 14 from slipping out to the side.

This configuration can be assembled easily through incorporating the charging terminal 52 and switch 14 into the charger connection unit 51 to compose a unit, and through engaging the unit with the lower unit 7 of the nozzle section 4. Lead wires 21 coming out of the charging terminal 52 includes those connected to the switch 14 and others connected to the power source battery 49, and are crossing across each other. But upon being relayed with the charger connection unit 51, the lead wires 21 can be arranged easily and neatly and prevented from being entangled. This provides a vacuum cleaner which is assembled easily and has an excellent quality.

As shown in FIG. 1 to FIG. 4, about the center line of the hand-holder 27 in the nozzle section 4, the blower 1 is provided at the right side and the battery 49 at the left side. And the dust collection box unit 2 and the rotary brush compartment 8 having the rotary brush 3 are disposed in parallel with each other to right and left.

This configuration does not position the weight to one side in the nozzle section 4, thus providing the cleaner with a weight balance. As a result, the main body is avoided from sinking or lifting at one side on the carpet while being carried and from tendency of bending on one side and not on other side.

As shown in FIG. 1 to FIG. 3 and FIG. 6, a nearly U-shaped foot 54 formed at one side of the rotary shaft 32 of the hand-holder 27 in the nozzle section 4 is composed to be fitted with the bump of the spring 33 fixed on the upper unit 6. In order that the rotary shaft 32 may move vertically, elliptical, not semicircular, shaft supports 68 are provided in the upper unit 6 and lower unit 7 of the nozzle section 4.

In this configuration, the switch 14 is designed to be operated by the turning hand-holder 27, and the nearly U-shaped foot 54 of the rotary shaft 32 is engaged with the bump of the spring 33. As the U-shaped foot 54 rides over the bump, the switch 14 is pushed and operated. When the cleaner main body is carried, the U-shaped foot 54 rides over the bump even by a slight impact if the engagement of the bump of the spring 33 and the U-shaped foot 54 is shallow. Thus, the switch 14 is operated by mistake. In order to prevent such erratic operation, in normal position, when the cleaner is lifted, the rotary shaft 32 moves upward by the weight of the cleaner, and the bump of the spring 33 bites into the U-shaped foot 54 to deepen the engagement. This prevents the U-shaped foot 54 from riding over the bump by a slight impact, so that the switch 14 may not be turned on, although the engagement of the bump of the spring 33 and the U-shaped foot 54 is shallow. That is, the hand-holder 27 is usually operated with a small force to turn on and off the switch 14. And when the cleaner is moved, the hand-holder 27 is not moved easily and does not have the switch 14 turned on or off, thus providing a controllable, easy-to-use vacuum cleaner.

As shown in FIG. 1 to FIG. 3, FIG. 7 and FIG. 8, the nearly U-shaped foot 54 is formed at one side of the rotary shaft 32 of the hand-holder 27 in the nozzle section 4. And the U-shape of the foot 54 is composed to be fitted with the bump of the spring 33 fixed on the upper unit 6. In order that the rotary shaft 32 may move vertically, elliptical, not semicircular, shaft supports 68 are provided in the upper unit 6 and lower unit 7 of the nozzle section 4. Further, in the lower unit 7 of the nozzle section 4, a spring 55 for pushing the rotary shaft 32 always upward is provided.

In this configuration, the switch 14 is also designed to be operated by the turning hand-holder 27. Then, the nearly U-shaped foot 54 of the rotary shaft 32 is engaged with the bump of the spring 33. As the U-shaped foot 54 rides over the bump, the switch 14 is pushed and operated. When the cleaner main body is carried, the U-shaped foot 54 rides over the bump even by a slight impact if the engagement of the bump of the spring 33 and the U-shaped foot 54 is shallow. And the switch 14 is thus operated by mistake. Therefore, in order to deepen the engagement of the bump of the spring 33 and U-shaped foot 54, when the cleaner main body is carried, that is, when the handle 5 is in a vertical position to the nozzle section 4, the spring 55 is provided in the lower unit 7 of the nozzle section 4 for always pushing up the rotary shaft 32. And this spring 55 pushes down the rotary shaft 32 by its own weight when the user grips the handle 5. That is, when the handle 5 is tilted by the user, the engagement of the bump of the spring 33 and the U-shaped foot 54 becomes shallow, so that the U-shaped foot 54 can ride over the bump easily. Thus, in normal operation, the hand-holder 27 can be operated with a small force. And when the cleaner is carried, the hand-holder 27 is not operated easily, thus carried more easily, so that a vacuum cleaner having an excellent controllability and being used easily can be presented.

As shown in FIG. 1 to FIG. 3, the blower 1, dust collection box unit 2, and rotary brush 3 are disposed in the nozzle section 4. The belt 41 for linking the pulley 39 and intermediate pulley 40 of the blower 1, and the belt 42 for linking the intermediate pulley 40 and pulley unit 36 of the rotary brush 3 are disposed in the belt compartment 56. The belts transmit rotation of the blower 1. The filter 48 is provided on the wall of the rotary brush compartment 8.

In the exhaust circulation loop for returning the exhaust passing through the filter unit 13 to the brush compartment 8, the belt compartment 56 is utilized as a passage of the exhaust circulation. Therefore, the belts and pulleys are exposed to the exhaust and are not contaminated by dust, and the dust is prevented from invading from outside. The passage is confronting the rotary brush compartment 8 of the rotary brush 3, but the filter 48 is provided to prevent the dust particles swept by the rotary brush 3 from invading. The cleaner, since having the belt compartment 56 composed in the exhaust circulation passage, does not need an extra exhaust circulation passage and has the cleaner main body be compact while maintaining the capacity of the dust collection box unit 2.

This configuration provides a silent, environment-friendly, lightweight vacuum cleaner.

As shown in FIG. 1 to FIG. 5, the vacuum cleaner according to the embodiment includes the blower 1, dust collection box unit 2, and rotary brush 3. These are disposed in the nozzle section 4. The cleaner further includes a handle 5 coupled to the nozzle section 4. An opening 57 is formed at the side of the nozzle section 4, and the dust collection box unit 2 at the opening 57. The dust collection box unit 2 is composed like a drawer.

In this configuration, when dust is collected in the dust collection box unit 2, the dust collection box unit 2 is drawn out from the opening 57 formed at the side of the nozzle section 4, and then, the dust is discarded. After the dust is discarded, the dust collection box unit 2 is inserted into the opening 57 and put back in its initial position.

Therefore, the handle is not needed to set on the dust collection box unit 2, and the design is not spoiled, so that a vacuum cleaner maintaining a sufficient dust collection capacity can be presented.

As shown in FIG. 1 to FIG. 3 and FIG. 9, the dust collection box unit 2 is disposed in the nozzle section 4, and the dust collection box unit 2 is composed like a drawer in a space enclosed by the lower unit 7 and window 24. Or the dust collection box unit 2 may be also composed in a space enclosed by the upper unit 6 and window 24.

In this configuration, the dust collection box unit 2 is disposed in a place enclosed by the lower unit 7 and the window 24 because this enclosed place is hardly moved by deviation of ribs due to impact from the front side of the cleaner main body. Therefore, the upper side is reinforced by composing of the lower unit 7 and fitting the window 24, thereby increasing rigidity and strength of an accommodated portion of the dust collection box unit 2 and the nozzle section 4. Although not explained herein, a place enclosed by the upper unit 6 and window 24 provides the same effect.

Figure 13:
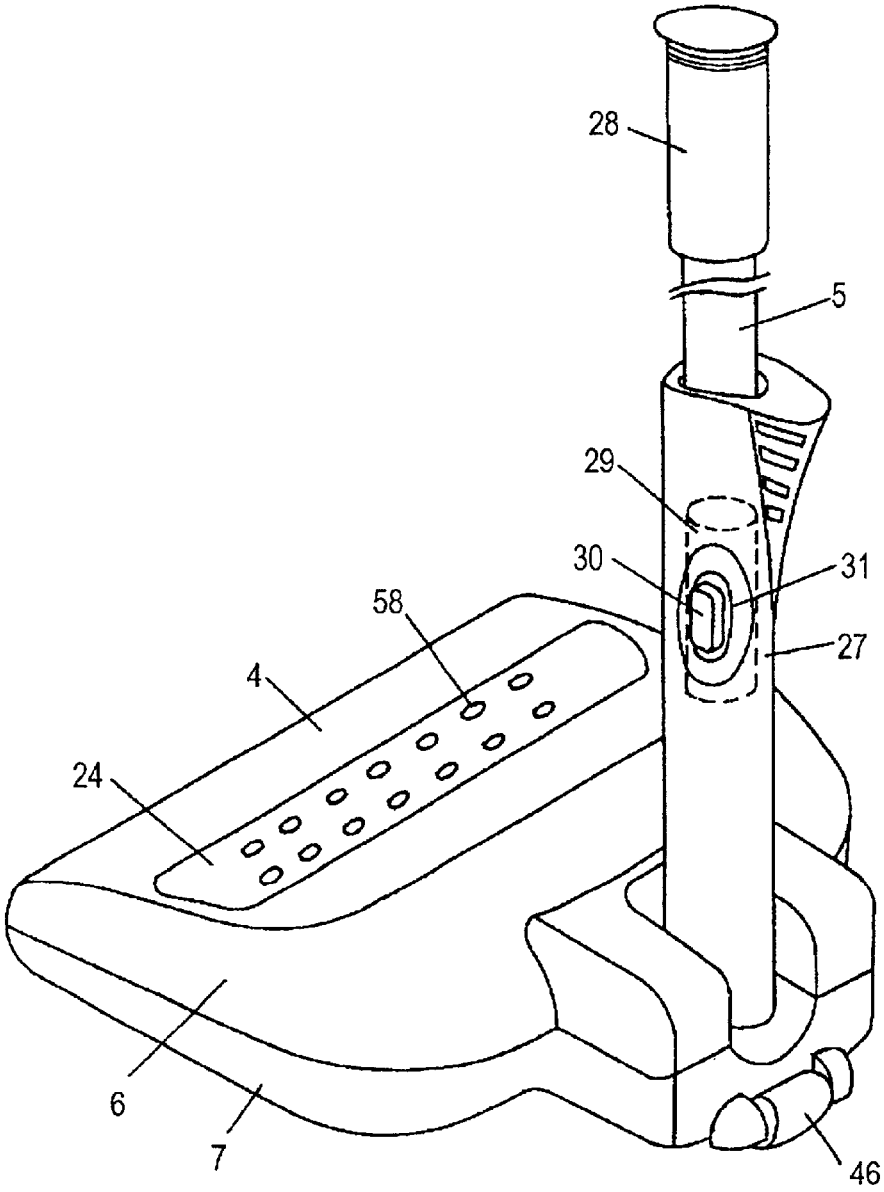
FIG. 13 is a perspective view of the vacuum cleaner.
Figure 14:
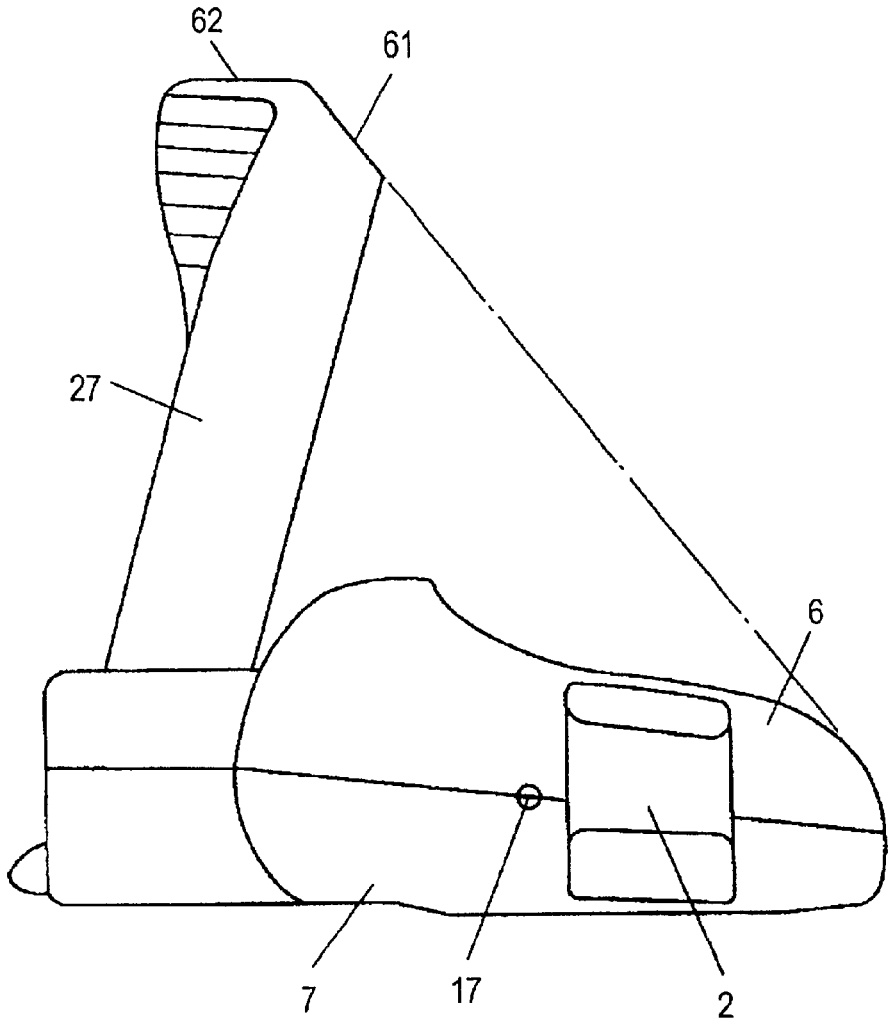
FIG. 14 is a side view of the vacuum cleaner.
Figure 15:
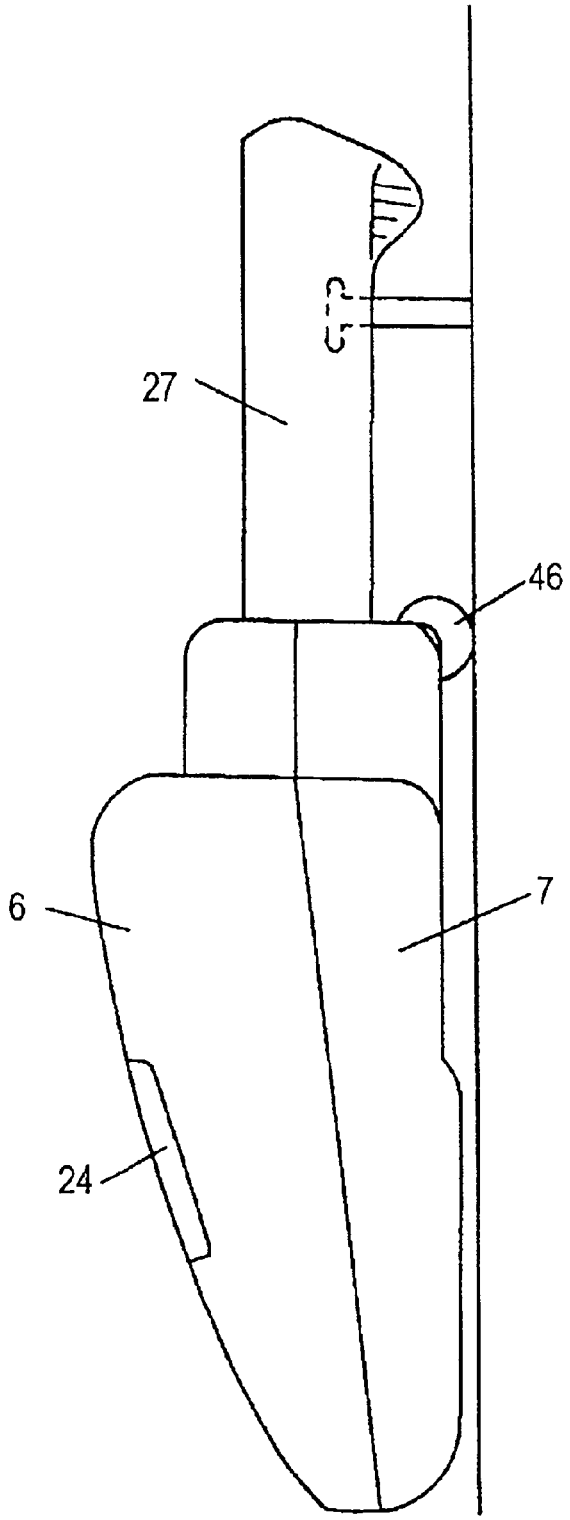
FIG. 15 is a side view of the vacuum cleaner.

Further, as shown in FIG. 13, one or more holes 58 formed in the window 24 make the inside of the dust collection box unit 2 be visible from the top of the cleaner main body. This allows the dust collecting level to be checked, thus providing an easy-to-use vacuum cleaner.

Figure 16:
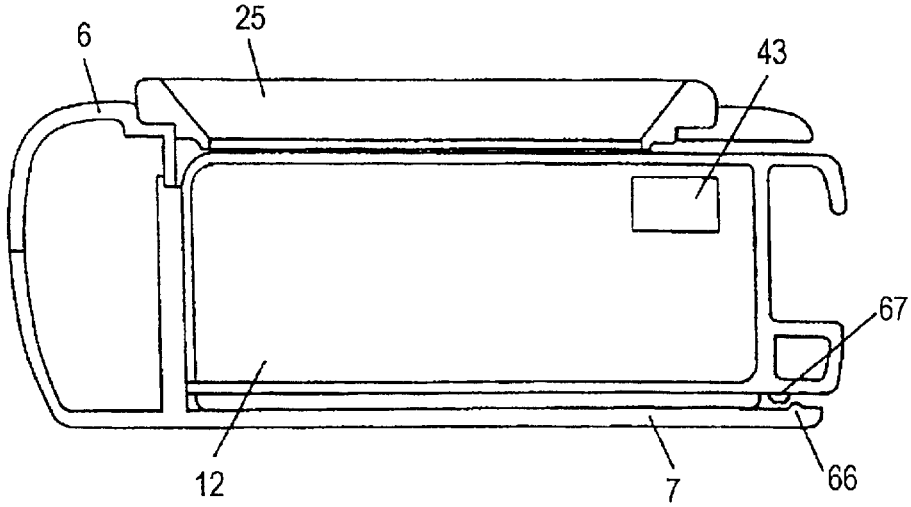
FIG. 16 is an essential sectional view of the vacuum cleaner.

As shown in FIG. 3 and FIG. 16, a rib 67 is provided at a lower side of the dust collection box 12, and a bump 66 is provided on the lower unit 7. When the dust collection box 12 is stored, the rib 67 of the dust collection box contacts with the bump 66 of the lower unit 7, and the dust collection box 12 is pushed upward. Then, the window 24 and lower unit 7 of the nozzle section 4 are deflected. Thus, upon riding over the bump 66, the dust collection box 2 can be stored and be prevented from dislocation from the nozzle section 4, thus providing an easy-to-use vacuum cleaner.

As shown in FIG. 1 to FIG. 3, the nozzle section 4 is divided into a front portion, i.e., a first outer frame 59, and a rear portion, i.e., a second outer frame 60. The blower 1, dust collection box unit 2, and rotary brush 3 are provided in the first outer frame 59, and the hand-holder 27 and switch 14 are provided in the second outer frame 60. The switch 14 is operated as the hand-holder 27 is turned. That is, the required airtight portions for suction and exhaust by the blower 1 are put in the first outer frame 59, and the portions prevented from dust, or the operating units to be manipulated by the user are put in the second outer frame 60.

In this configuration, the rotary brush 3, dust collection box unit 2, and blower 1 require a sufficient space for working efficiency, and they are put in the first outer frame 59 to assure a sufficient dust collecting performance in this space. The other parts relating to manipulation by the user are put in the second outer frame 60. This allows the vacuum cleaner to be used easily, to be small and compact. The cleaner thus has sense of volume as seen from the front side limited to the first outer frame 59 only, so that the design of appearance is not spoiled.

As shown in FIG. 1 to FIG. 3 and FIG. 14, when the hand-holder 27 is tilted forward, a surface 61 linking to the forward upper surface of the nozzle section 4 is formed on the upper surface of the hand-holder 27. Simultaneously, a surface 62 parallel with the ground contacting surface of the cleaner main body is formed on the upper surface of the hand-holder 27.

This configuration make a user hardly work while holding the cleaner main body when replacing or repairing the rotary brush 3. However, the surface 61 can be placed on the floor for ease of the work, and the surface 62, upon being parallel with the ground-contacting surface when the cleaner is packed with the hand-holder 27 inclined, allows the package size to be reduced.

Thus, the vacuum cleaner can be repaired more easily, and have a reduced package size.

As shown in FIG. 1 to FIG. 3 and FIG. 15, the switch 14 is designed to be turned on and off by the turning hand-holder 27. The hand-holder 27, upon being in the upright position and the horizontal tilted position makes the switch 14 turned off, and, upon being in a turning range between the upright position and horizontal position, makes the switch 14 turned on.

This configuration allows the switch 14 to be operated by the turning hand-holder 27. While being used, the hand-holder does not reach a horizontal position until contacting with the floor and thus, leaving the switch 14 turned on. When the cleaner is stored, the switch 14 is turned off in the horizontal position of the holder. Therefore, the cleaner has the hand-holder 27 tilted horizontally and can be put on the wall with being flat. This allows a storing space to be reduced and thus to be stored at any place.

Thus, a vacuum cleaner having an excellent controllability and reduced install space can be presented.

As shown in FIG. 1 to FIG. 3, FIG. 7 and FIG. 8, the nearly U-shaped foot 54 formed at one side of the rotary shaft 32 of the hand-holder 27 in the nozzle section 4 is fitted with the bump of the spring 33 fixed on the upper unit 6. In order that the rotary shaft 32 may move vertically, elliptical, not semicircular, shaft supports 68 is provided in the upper unit 6 and the lower unit 7 of the nozzle section 4. Further, in the lower unit 7 of the nozzle section 4, a spring 55 for pushing the rotary shaft 32 upward is provided. Moreover, the switch 14 is provided in the rotary shaft 32 together with the switch support plate 34. The switch 14 moves up and down according to a vertical motion of the rotary shaft 32. A rib 63 for fixing the switch support plate 34 is also provided from the lower unit 7.

In this configuration, the switch 14 is operated by the turning hand-holder 27, and the nearly U-shaped foot 54 of the rotary shaft 32 is engaged with the bump of the spring 33. As the U-shaped foot 54 rides over the bump, the switch 14 is pushed and operated. When the cleaner main body is carried, the U-shaped foot 54 rides over the bump even by a slight impact if the engagement of the bump of the spring 33 and the U-shaped foot 54 is shallow. Thus, the switch 14 is operated by mistake. In order to deepen the engagement of the bump of the spring 33 and U-shaped foot 54 in the ordinary position, the spring 55 is provided in the lower unit 7 of the nozzle section 4 for always pushing up the rotary shaft 32. And the spring 55 thus pushes down the rotary shaft 32 by its own weight when the user grips the handle 5. Thus, the engagement of the bump of the spring 33 and the U-shaped foot 54 is made shallow. This allows the U-shaped foot 54 to ride over the bump of the spring 33 easily. At this moment, the switch 14 moves up and down similarly to the rotary shaft 32.

Thus, a vacuum cleaner excellent in controllability and easy to use can be presented.

Further, as shown in FIG. 1 to FIG. 3, the blower 1, dust collection box unit 2, and rotary brush 3 are disposed in the nozzle section 4. The belt 41 for linking the pulley 39 and the intermediate pulley 40 of the blower 1, and the belt 42 for linking the intermediate pulley 40 and pulley unit 36 of the rotary brush 3 are disposed in the belt compartment 56. The belts transmit a rotation of the blower 1. An exhaust filter 23 is provided opposite to the rotary brush compartment 8.

In this configuration, the blower 1 rotates, and the intermediate pulley 40 is accordingly rotated by the belt 41, and the rotation is transmitted to the rotary brush 3 through the belt 42. Therefore, dust is swept away from the cleaning surface.

This provides a lightweight vacuum cleaner which does not include a second motor.

As described herein, in the vacuum cleaner according to the embodiment, the blower 1, the dust collection box unit 2 and the rotary brush 3 as the working elements of the cleaner are disposed in the nozzle section 4. And, the handle 5 is coupled to the nozzle section 4. Since the working elements of the cleaner is supported by the upper unit 6 of the nozzle section 4 and other member or by the lower unit 7 and other member, the cleaner has the rotary brush 3 replaced without having all screws removed. This enhances repairing efficiency.

The vacuum cleaner according to the embodiment includes the working elements of the cleaner, that is, the blower 1, the dust collection box unit 2, and the dust suction port 9 having the rotary brush 3. The working elements are disposed in the nozzle section 4, and the handle 5 is coupled to the nozzle section 4. Therefore, the dust suction port 9 for leading dust particles from the rotary brush compartment 8 into the dust collection box unit 2 is disposed slightly above the center in the height direction of the dust collection box unit 2 at a side opposite to the belt in the rotary brush compartment 8. As a result, when the dust collection box unit 2 is took out, or when the cleaner main body is carried, the dust particles do not spill away. This allows the cleaner to be used easily and to exhibit enhanced performance.

The vacuum cleaner according to the embodiment, at least two surfaces are provided on the top of the hand-holder 27. That is, the surface links to the top ahead of the nozzle section 4 when the cleaner main body is tilted forward at one side. Then, the plane surface is positioned in parallel with the ground contact surface when the hand-holder 27 is tilted at other side. This allows the cleaner to be repaired easily and to have a reduced package size.

The vacuum cleaner according to the embodiment includes the switch 14 operated with the turning hand-holder 27. The switch 14 is turned off when the cleaner main body is tilted to flat or more than flat. When the cleaner is stored, the switch is turned off automatically with the cleaner main body to be set in flat, to be putting on a wall hook or the like. This reduces its storing space.

The switch 14 is provided in the rotary shaft 32 of the hand-holder 27, and is operated by the turning hand-holder 27. Therefore, the rotary shaft 32 is moved up and down, and the switch 14 is accordingly turned on and off. This allows the cleaner to be used conveniently.

The cleaner according to the embodiment includes the working elements of the cleaner, that is, the blower 1, dust collection box unit 2, and rotary brush 3 disposed in the nozzle section 4. And the handle 5 is coupled to the nozzle section 4, in which the terminal 52 and the switch 14 are assembled in the charger connection unit 5. A side wall of the cleaner main body prevents the switch 14 from slipping out by. This allows the cleaner to be assembled easily.

While allowing a vertical play in the rotary shaft 32 of the hand-holder 27 attached to the nozzle section 4 having the dust collecting mechanism, the hand-holder 27 is supported by engagement between the spring 33 composed in the upper unit 6 of the nozzle section 4 and the foot of the hand-holder 27, and therefore the locking force of the hand-holder 27 is increased, and the nozzle section 4 is prevented from being lifted during use, so that the ease of use is enhanced.

The spring 55 for always applying a force upward from beneath is provided in the foot of the hand-holder 27. As a result, the hand-holder 27 is pushed up, and the spring 33 moves into the foot of the hand-holder 27. This stabilizes the handle 5 without looseness, and allows the cleaner to be used easily.

The cleaner according to the embodiment includes the blower 1, the rotary brush 3, and the belt compartment 56 incorporating the belt for linking the blower 1 and the rotary brush 3. The compartment is composed in the exhaust passage, and therefore, preventing the exhaust from being discharged outside, but has the exhaust circulated within the cleaner main body. This provides a silent, environment-friendly vacuum cleaner.

The cleaner according to the embodiment includes the working elements of the cleaner, that is, the blower 1, the dust collection box unit 2, and rotary brush 3. These are disposed in the nozzle section 4, and the handle 5 is coupled to the nozzle section 4, in which the dust collection box unit 2 can be freely drawn out of the opening 57 provided at the side of the cleaner main body. As a result, the cleaner does not require a handle on the top of the dust collection box unit 2, does have its design not spoiled, and does maintain the dust collection capacity.

The cleaner according to the embodiment includes the dust collection box unit 2 composed of a dust collection box main body 12 and a filter unit 13 detachably fitted to the dust collection box main body. A window 24 is provided on the top of the cleaner main body so as to cover the dust collection box unit 2. In the compartment enclosed by the window 24 and one of the lower unit 7 and the upper unit 6, the dust collection box unit 2 is installed like a drawer. Since the opening is reinforced by other member, the cleaner become stronger.

Further, functional parts, that is, the blower 1, (lust collection box unit 2, and rotary brush 3 are installed in a first outer frame 59 ahead of the cleaner main body, while the handle 5 and switch 14 are put in a second outer frame 60. As a result, in suction and exhaust by the blower 1, the parts are divided into required airtight parts and dust-free parts. This allows the cleaner to be repaired more conveniently.

In the cleaner, the working elements of the cleaner, that is, the blower 1, dust collection box unit 2, and rotary brush 3 are disposed in the nozzle section 4. The handle 5 is coupled to the nozzle section 4. The battery 49 and the blower 1 are distributed to right and left side of the nozzle section 4. This provides the cleaner with a uniform weight balance and allows the cleaner to be used and carried more easily.

The blower 1, the rotary brush 3, and a speed reducer are concentrated in the nozzle section 4. The rotation of the blower 1 is decelerated by the intermediate pulley 40, and is further decelerated by the rotary brush 3. This allows the cleaner to include no second motor, to have the reduced weight, and to be used easily.

(Embodiment 2)

Referring to the drawings, embodiment 2 of the invention will be explained below.

As shown in FIG. 17 to FIG. 20, the case of a nozzle section 74 is composed of an upper unit 76, a lower unit 77, a window 105, a lid 135, a belt cover 129, and a support plate 120. The case incorporates a blower 71, a dust collection box unit 72, a rotary brush 73, a safety device 87, a switch 84, and a hand-holder 99. An aluminum handle 75 is detachably fitted to the hand-holder 99. The handle 75 is composed of three or four aluminum pipes coupled to each other. A grip 121 of the handle 75 is the position to be gripped by a user. In the center of the attaching unit 122 of the handle 75 engaged with the hand-holder 99, an elastic ratchet 100 is provided, and is engaged with a hole 123 in the hand-holder 99.

One side of a rotary shaft 125 of the hand-holder 99 forms a foot to fit with a spring 124 having a nearly U-shape. Other side of the rotary shaft 125 fits the switch 84 to a switch support plate 126, and the rotary shaft 125 is inserted in the switch support plate 126 attached the switch 84.

In a rotary brush compartment 78, the rotary brush 73 is disposed, and the belt cover 129 is provided so as to cover a pulley 128. A fan 131 is press-fitted at one side of a shaft 130 of the blower 71. A pulley 109 is attached to other end of the shaft 130. The pulley 109 is linked to an intermediate pulley 110 with a belt 111, and the intermediate pulley 110 and a pulley 128 are linked with a belt 112.

Figure 21:
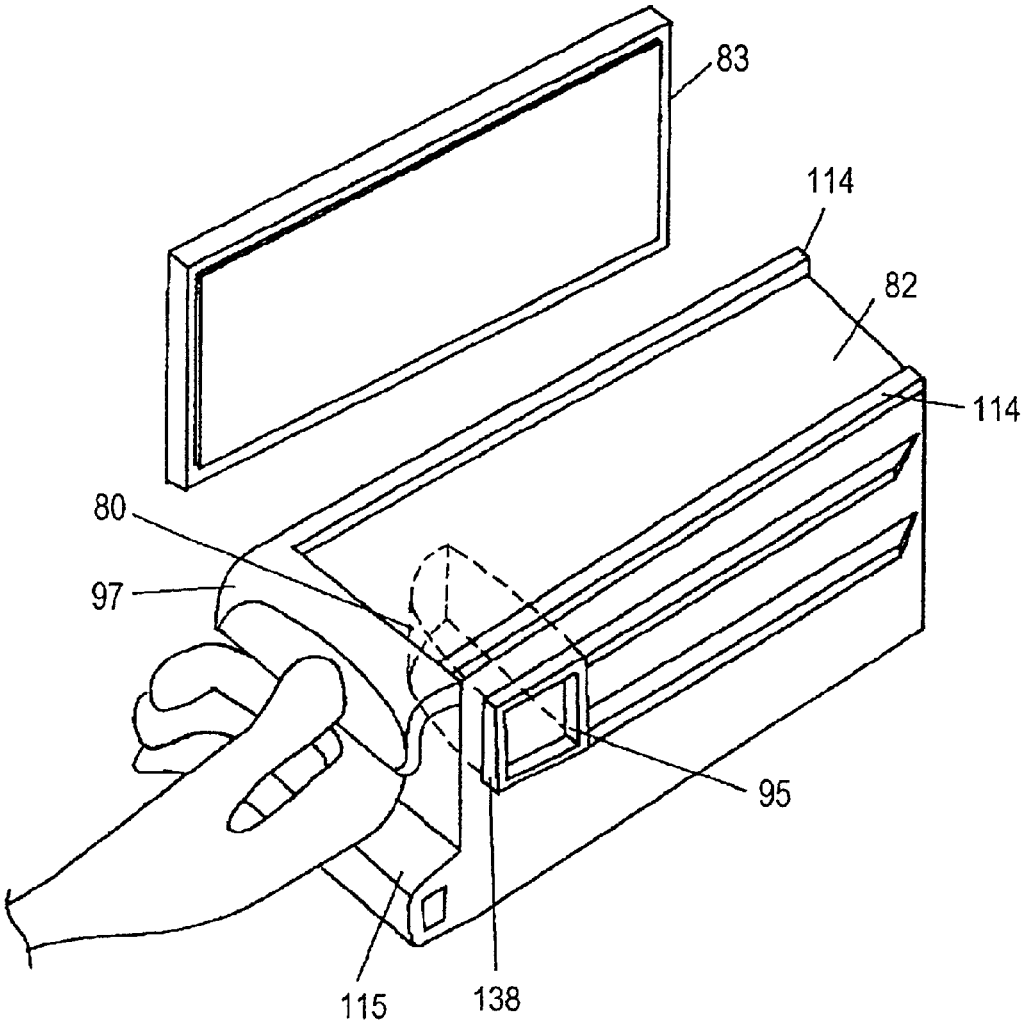
FIG. 21 is a perspective exploded view of a dust collection box of the vacuum cleaner.
Figure 22:
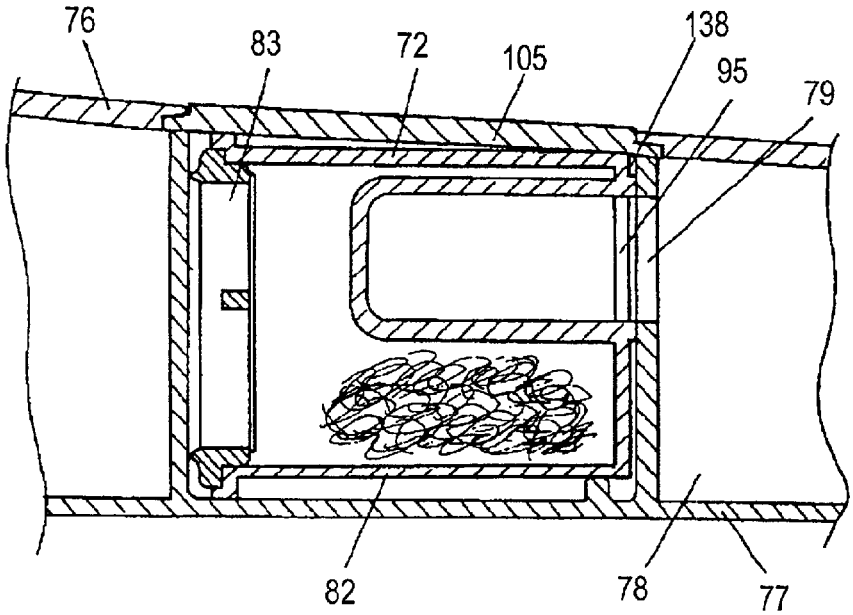
FIG. 22 is an essential sectional view of the vacuum cleaner.

The dust collection box unit 72 is, as shown in FIG. 21 and FIG. 22, composed of a dust collection box 82 and a filter unit 83. An intake port 95 of the dust collection box 82 is surrounded by a bump 138, and is engaged with the surface of a dust suction port 79 in the rotary brush compartment 78.

A brush 132 is disposed at the front side of the nozzle section 74, and a brush 133 is disposed at the lower side of the center of the cleaner main body. A roller 134 is provided behind the section.

An operation of the vacuum cleaner having such configuration will be explained. Upon being turned from a 90-degree upright position by a certain angle about the rotary shaft 125, the handle 75 have the switch 84 turned on. When the switch 84 is turned on, the blower 71 starts to rotate, and rotate the rotary brush 73 through the intermediate pulley 110. Dust particles swept by the rotary brush 73 are sent into the dust collection box unit 72 from the dust suction port 79 through the intake port 95, and collected in the dust collection box unit 72 without passing through the filter unit 83 provided at the outlet. The exhaust passing through the filter unit 83 also passes through the filter 117, and further, passes through the blower 71 and filter 118. Then, the exhaust is discharged into the rotary brush compartment 78. When the handle 75 is returned to the original position, the operation stops.

The dust collection box unit 72 is composed of the dust collection box main body 82 and the filter unit 83 detachably fitting to the dust collection box main body 82. The rotary brush 73 is disposed in the rotary brush compartment 78 of the nozzle section 74, which sweeps away the dust particles from a carpet. By the suction force of the blower 71, the dust particles pass through the dust suction port 79, pass through the intake port 95 of the dust collection box unit 72 and the suction passage 80. Then, the particles are filtered by the filter unit 83, thus being captured.

In this configuration, flow of air passes through the dust suction port 79. The dust collection box 82 includes a suction passage 80 having an intake port 95 and an outlet in a nearly L-shape similar to the intake port 95 of the dust collection box 82. The suction passage 80 changes the flow direction by 90 degrees laterally, and therefore, the air flows in parallel with the filter unit 83 in the inner parts of the (lust collection box 82. Suction from the blower 71 is applied from a position behind the center of the dust collection box 82.

Therefore, since the flow of air taken in the dust collection box unit 72 passes in parallel with the filter unit 83 of the dust collection box unit 72, dust particles are collected from the inner part of the dust collection box 82. Therefore, a user is noticed of a dust collection level, so that an easy-to-use vacuum cleaner can be presented.

Dust particles swept by the rotary brush 73 are sent into the dust collection box unit 72 from the dust suction port 79 through the intake port 95, and collected in the dust collection box unit 72 without passing through the filter unit 83 provided at the outlet. Exhaust from the blower 71 is not discharged to outside from the nozzle section 74. The exhaust passing through the filter unit 83 also passes through the filter 117, and further, passes through the blower 71 and filter 118. Then the exhaust is discharged into the rotary brush compartment 78. This exhaust circulation loop provides a vacuum cleaner being silent in operation and friendly to environments.

Figure 19:
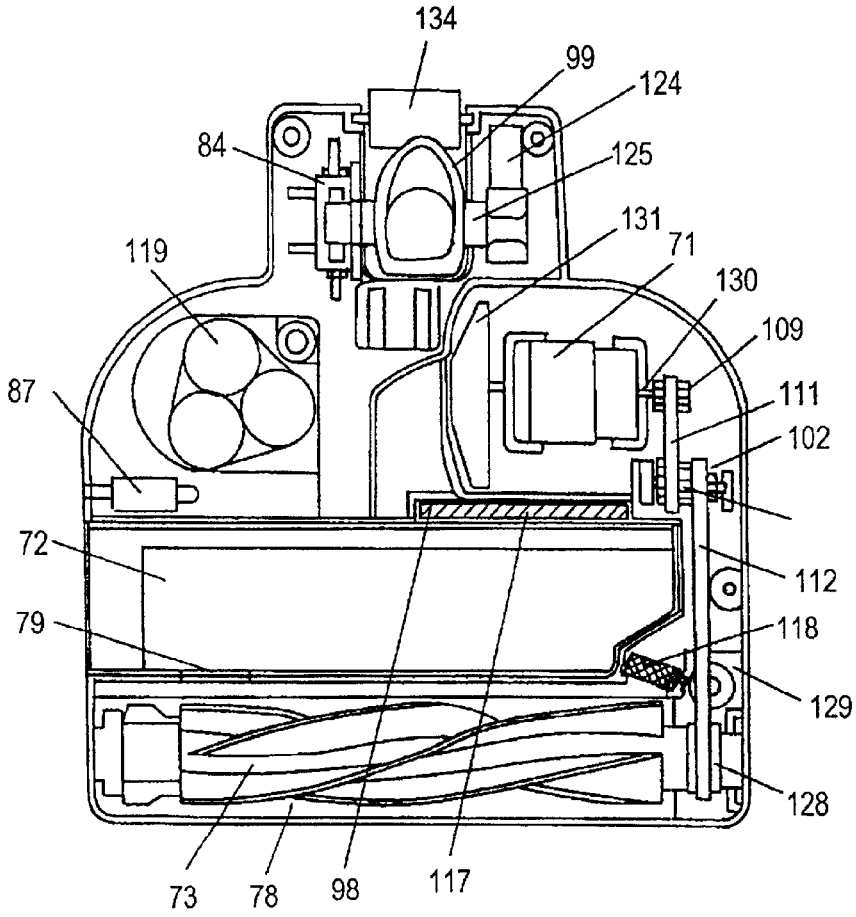
FIG. 19 is a horizontal cross sectional view of the vacuum cleaner.
Figure 23:
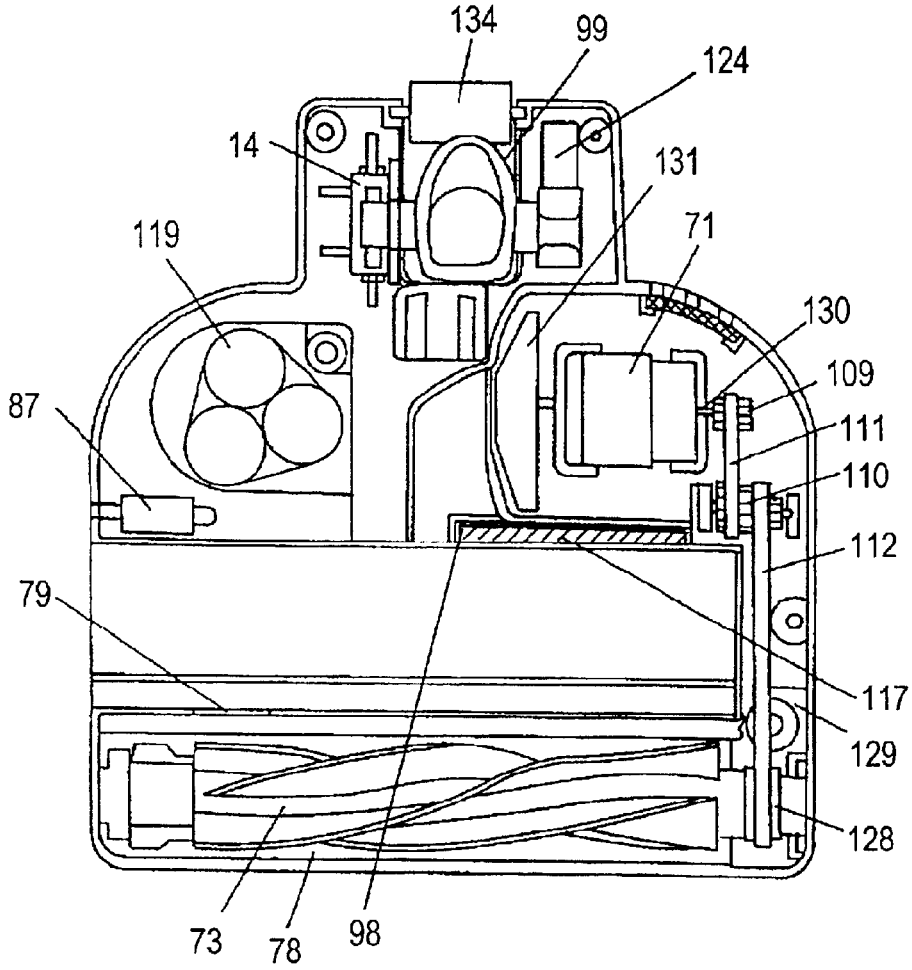
FIG. 23 is a horizontal cross sectional view of the vacuum cleaner.
Figure 24:
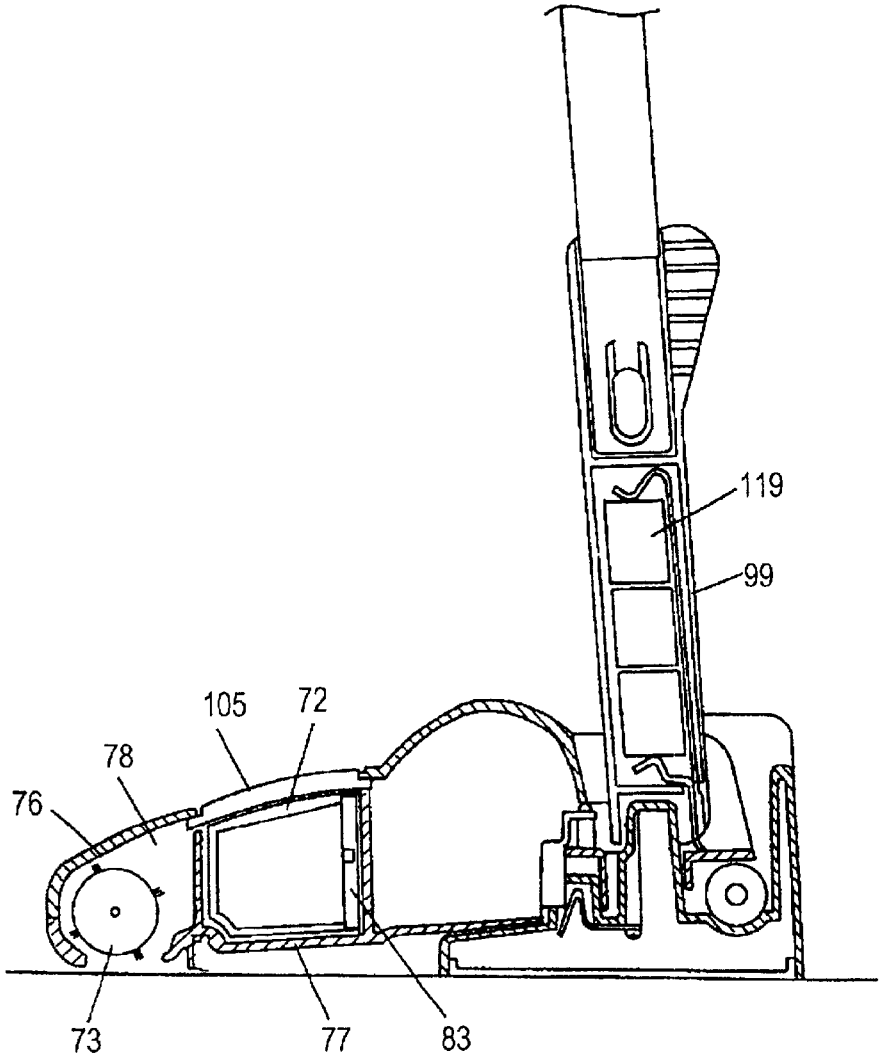
FIG. 24 is a side cross sectional view of the vacuum cleaner.

As shown in FIG. 19, FIG. 23, and FIG. 24, regardless of the presence of the exhaust circulation loop, the battery 119 may be provided in the nozzle section 74 or in the hand-holder 99, or in both nozzle section 74 and hand-holder 99. This provides a cordless and easy-to-use vacuum cleaner.

The rotary brush 73 is twisted spirally, and the dust suction port 79 in the rotary brush compartment 78 carries dust particles by a spirally-twisted-bristle on the brush in the rotating direction of the rotary brush 73. Accordingly, the dust suction port 79 is provided at the dusts carrying side. This provides a vacuum cleaner of an excellent dust collection performance.

Figure 25:
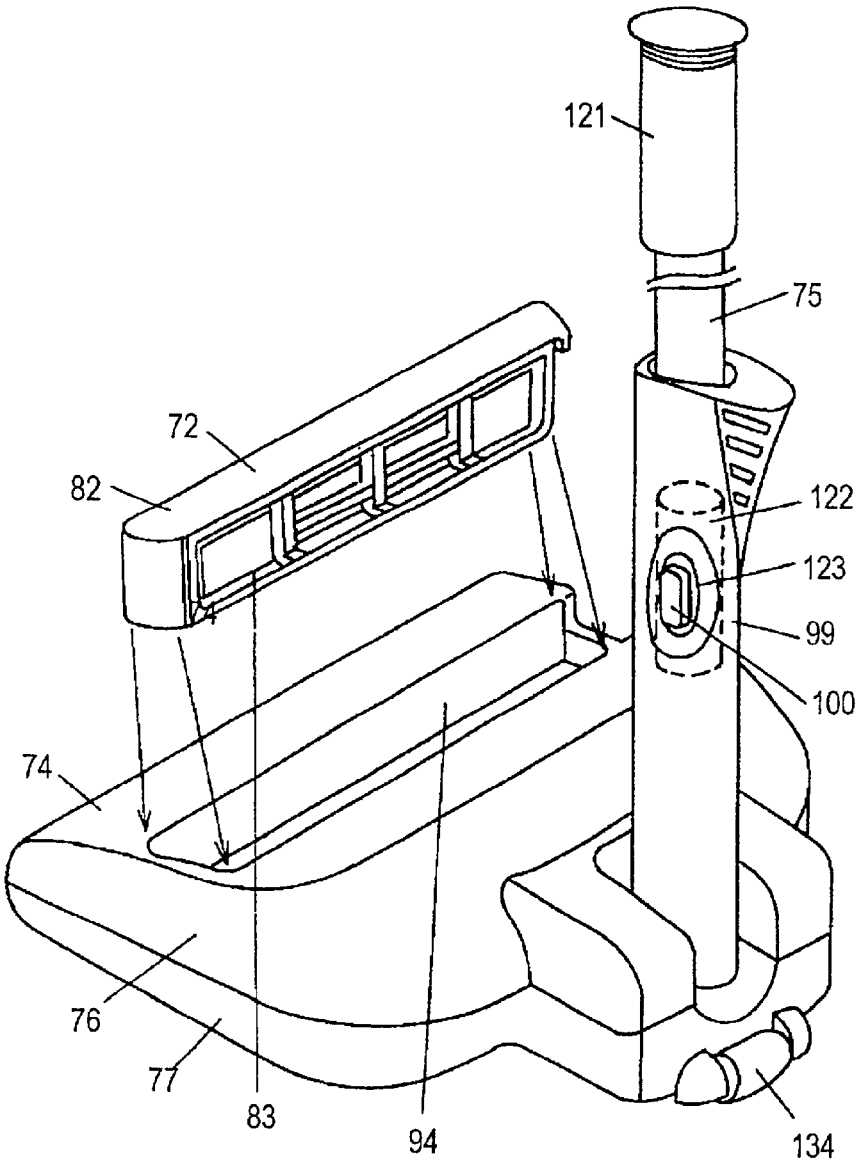
FIG. 25 is a perspective exploded view of the vacuum cleaner.

Further, as shown in FIG. 25, the dust collection box unit 72 is installed in the recess 94 of the nozzle section 74 from above. The four corners of the dust collection box unit 72 and the recess 94 of the nozzle section 74 can fit to each other. The box can be installed only from one direction. That is, the installing direction is only one, and the corners are not matched in other directions. Thus, the dust collection box unit 72 can be installed in the nozzle section 74 only in one direction, and can not be installed in a wrong direction. This assures the quality of the cleaner.

As shown in FIG. 17 to FIG. 21, the dust collection box unit 72 is composed of the dust collection box main body 82 and the filter unit 83 detachably fitted to the dust collection box main body 82. The rotary brush 73 is disposed in the rotary brush compartment 78 of the nozzle section 74, and sweeps away dust particles from the carpet. The suction force by the blower 71 has dust particles pass through the dust suction port 79, pass through the intake port 95 of the dust collection box unit 72 and the suction passage 80. Then, the particles are filtered by the filter unit 83, thus being captured. At this time, the intake port 98 of the blower 71 is provided diagonally, nearly in the width direction, to the intake port 95 of the dust collection box unit 72.

In this configuration, air passes through the dust suction port 79. In the dust collection box main body 82, a suction passage 80 is formed. The passage has an inlet, i.e., the intake port 95, and an outlet with a nearly L-shape is similar to the intake port 95 of the dust collection box main body 82. The passage changes the flow direction by 90 degrees laterally, and therefore, the air flows in parallel to the filter unit 83 in the inner parts of the dust collection box main body 82. Suction by the blower 71 is applied from an inner part of the dust collection box 82, and dust particles are collected from the inner part of the dust collection box 82. As a result, since the flow of air taken in the dust collection box unit 72 passes in parallel with the filter unit 83 of the dust collection box unit 72, dust particles are collected from the inner part of the dust collection box 82. Thus, a user is noticed of dust collection level. This provides a vacuum cleaner used easily.

As shown in FIG. 17 to FIG. 22, the cleaner according to the embodiment has the rotary brush 73 disposed in the rotary brush compartment 78. Dust is sent into the dust collection box unit 72 through the dust suction port 79. The intake port 95 of the dust collection box unit 72 is surrounded by the bump 138 fitting directly into the dust suction port 79.

When the dust collection box unit 72 is installed in the nozzle section 74, an elastic element of the filter unit 83, which includes a filter paper attached to the elastic element, is pressed and deflected with the nozzle section 74 if the intake port 95 of the dust collection box 82 hits against the dust suction port 79. As a result, the bump 138 of the intake port 95 and the dust suction port 79 contact face to face with each other, and thus, are connected securely. Simultaneously, the filter unit 83 and the nozzle section 74 are also pressed and fixed firmly, so that the vacuum cleaner of high performance can employ a small number of parts.

Figure 26:
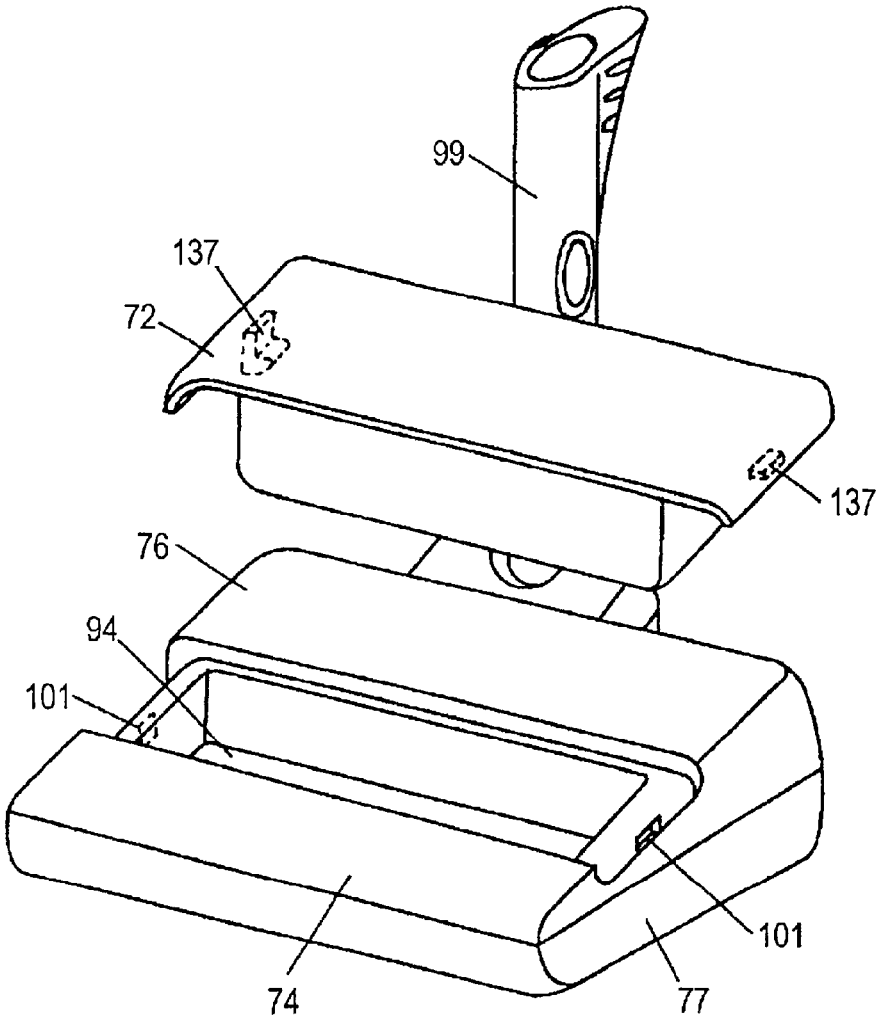
FIG. 26 is a perspective exploded view of the vacuum cleaner.

As shown in FIG. 26, the dust collection box unit 72 is installed in the recess 94 of the nozzle section 74 from above. The four corners of the dust collection box unit 72 and the recess 94 of the nozzle section 74 fit to each other. This allows the box unit 72 to be installed only from one direction. Moreover, said box unit 72 and nozzle section 74 are fixed and held by a ratchet 137 in a portion extended from the top of box unit 72 engaged to a holding part 101 on the top of the nozzle section 74.

When the dust collection box unit 72 is installed in the recess 94 of the nozzle section 74, the box unit 72 functions as a guide. The ratchet 137 in a portion extended from the top of the dust collection box unit 72 fits to the holding part 101 on the top of the nozzle section 74. When being dismounted, the dust collection box unit 72 functions as a guide so as to be pulled out upward. At this moment, the ratchet 137 can be visually checked, and the box unit 72, since being provided on the top, is prevented from dust particles. This provides a vacuum cleaner stable in quality and easy in attaching or detaching of dust collection box unit 72.

Figure 27:
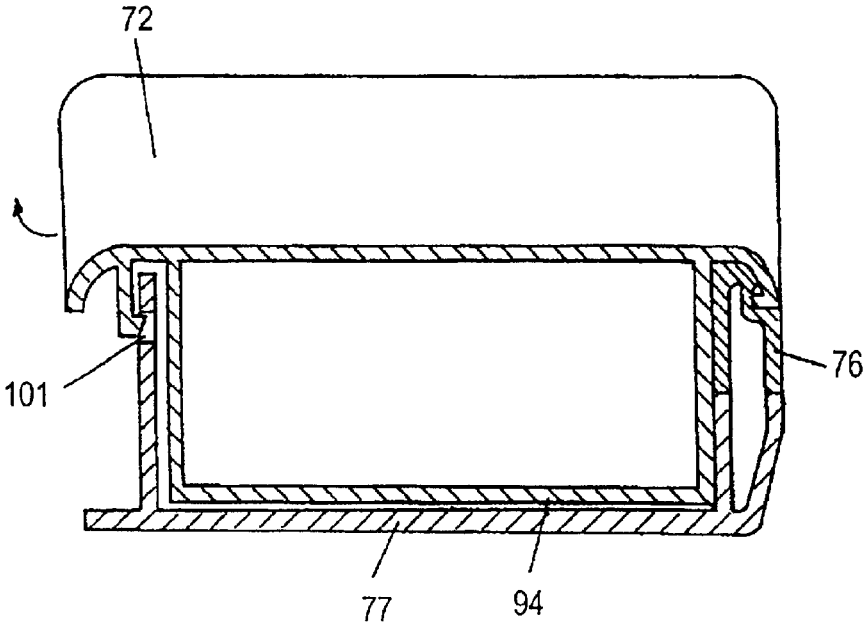
FIG. 27 is an essential sectional view of the vacuum cleaner.
Figure 28:
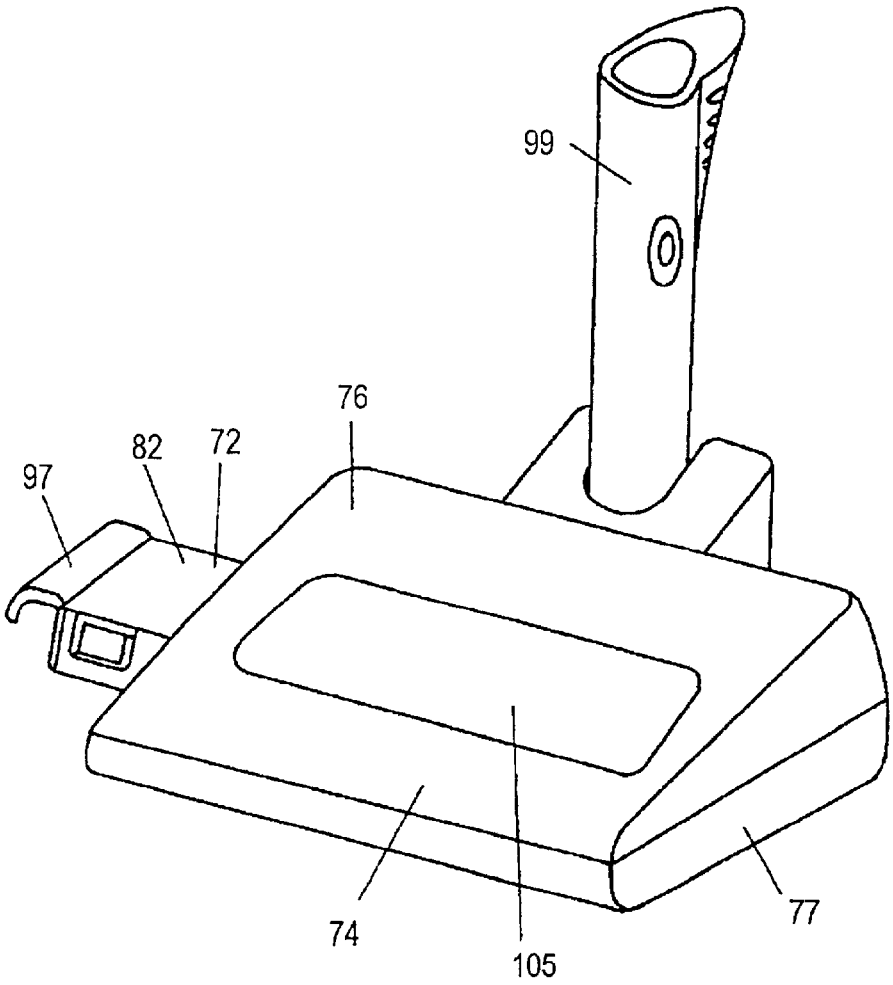
FIG. 28 is a perspective view of the vacuum cleaner.
Figure 29:
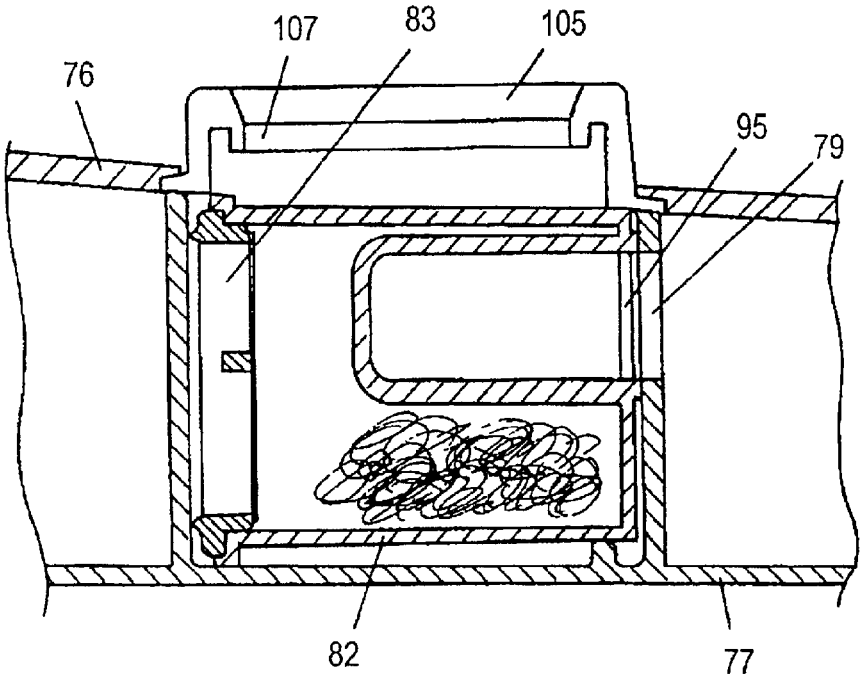
FIG. 29 is an essential cross sectional view of the vacuum cleaner.
Figure 30:
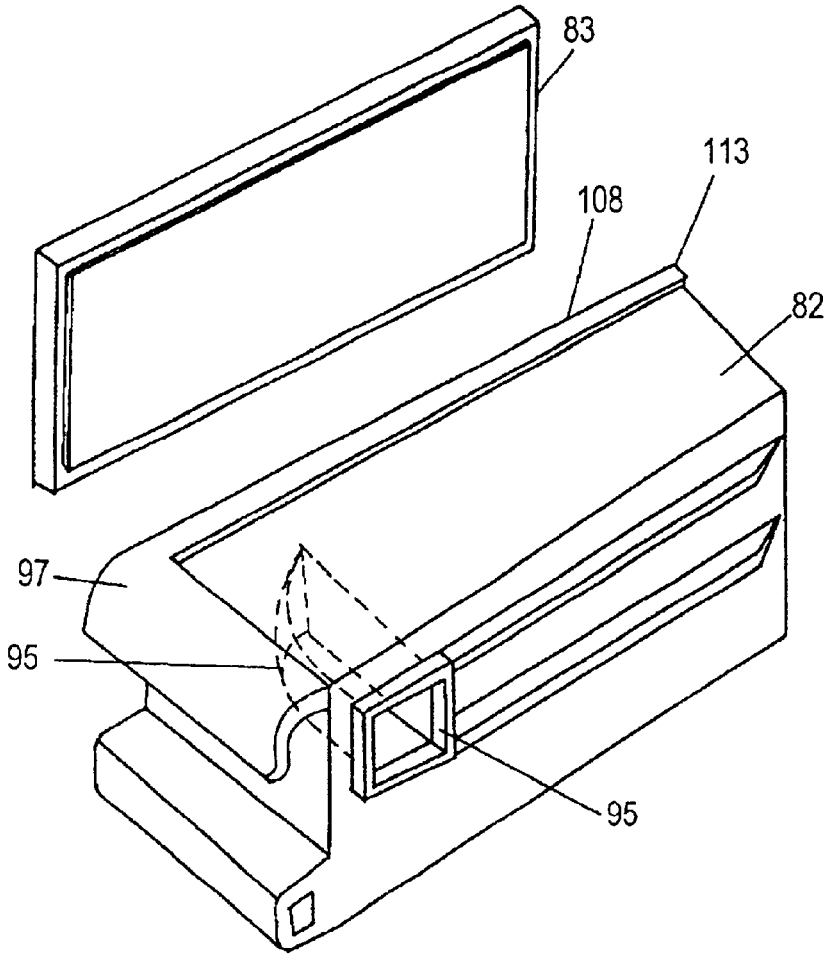
FIG. 30 is a perspective exploded view of the dust collection box of the vacuum cleaner.

As shown in FIG. 26 and FIG. 27, the dust collection box unit 72 is installed in the recess 94 of the nozzle section 74 from above. The four corners of the dust collection box unit 72 and the recess 94 of the nozzle section 74 fit to each other. The box unit 72 can be installed only from one direction. Moreover, the dust collection box unit 72 and nozzle section 74 are fixed to each other in two parts. In one part, a ratchet 137 provided in a portion extended from the top of the dust collection box unit 72 is engaged to a holding part 101 provided on the top of the nozzle section 74. In other part, the holding part 101 at the opposite side of a belt compartment 102 of the nozzle section 74 is engaged to the corresponding ratchet 137 in the grip 97 of the dust collection box unit 72.

In this configuration, when being installed in the recess 94 of the nozzle section 74 from above, the dust collection box unit 72 itself functions as a guide, thus being securely fixed into the recess of the nozzle section 74. In order to detach the dust collection box unit 72 from the recess 94 of the nozzle section 74, the grip 97 of the dust collection box unit 72 is pulled out. Then, the ratchet 137 of the grip 97 is detached from the holding part 101. And the ratchet 137 on the top of the belt compartment 102 is also detached from the holding part 101 by the dust collection box unit 72 on the top of the belt compartment 102 turning about the rotary shaft. Thus, the grip 97 of the dust collection box unit 12 at the opposite side of the belt compartment 102 and the dust collection box unit 72 on the top of the belt compartment 102 provides an easy-to-detaching and easy-to-use vacuum cleaner.

Figure 17:
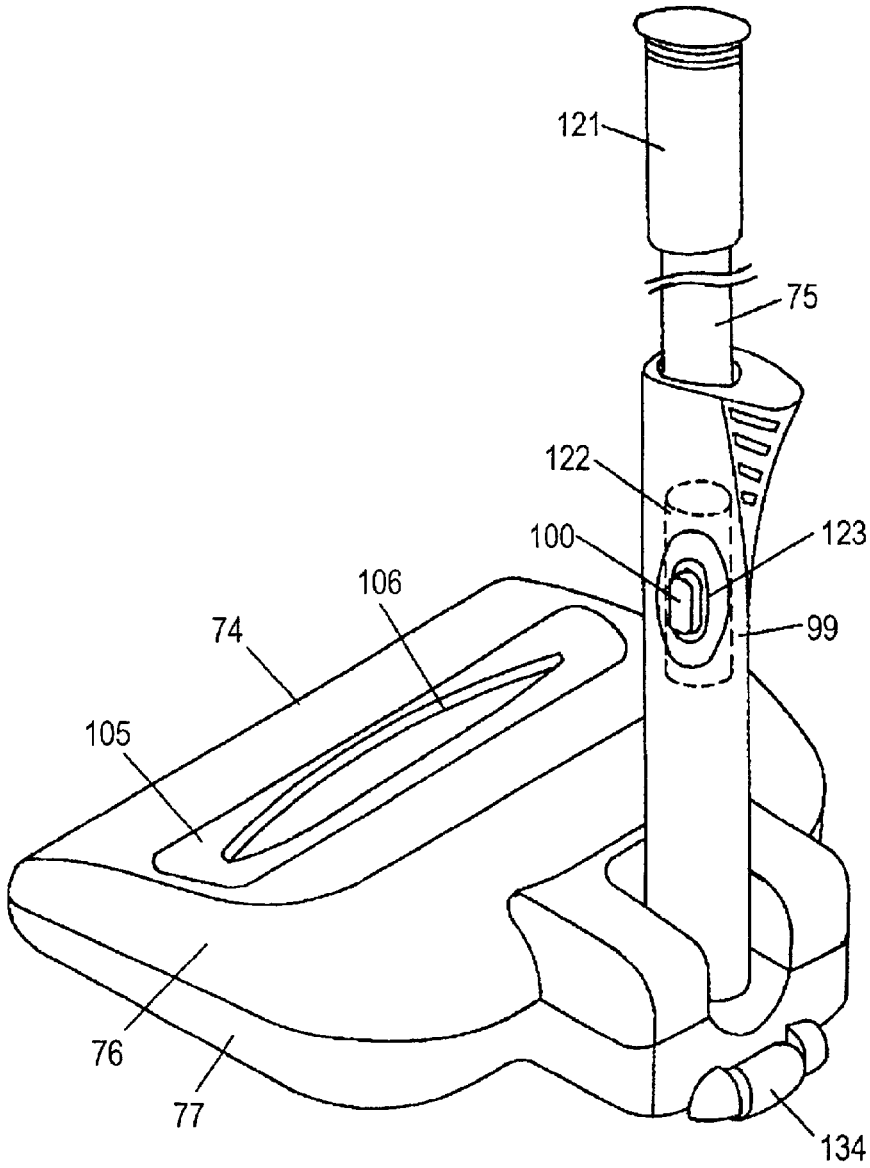
FIG. 17 is a perspective view of a vacuum cleaner according to embodiment 2 of the invention.
Figure 18:
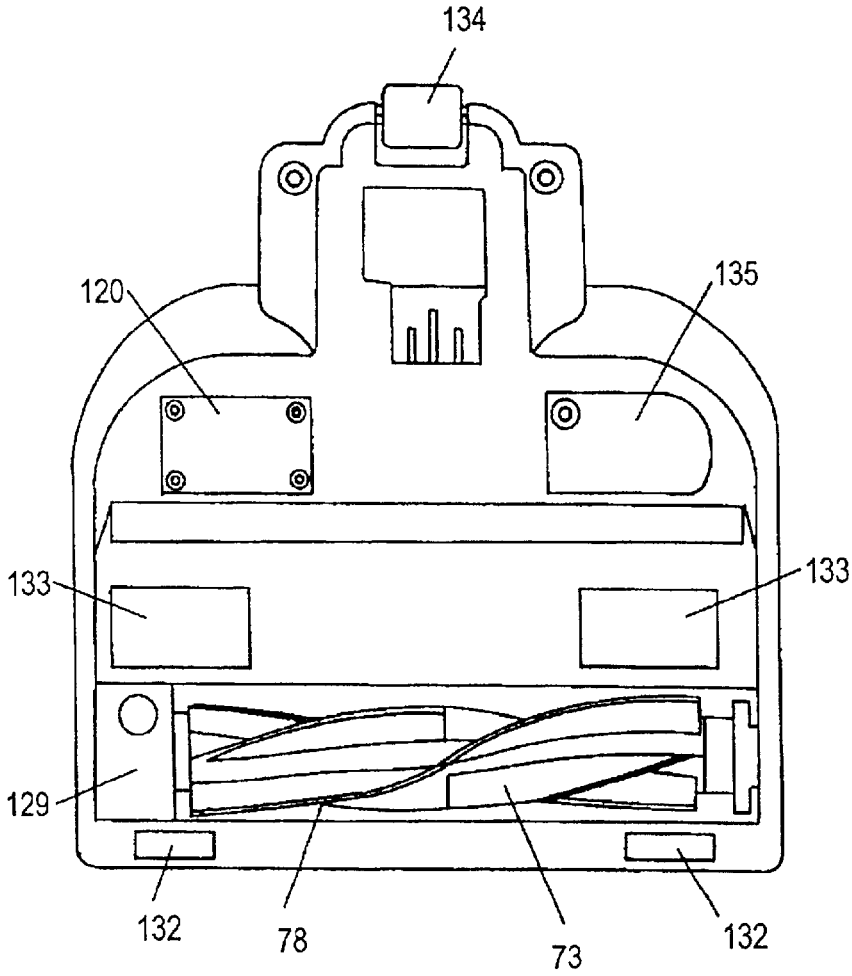
FIG. 18 is a bottom view of the vacuum cleaner.

As shown in FIG. 17 to FIG. 19, the blower 71, the dust collection box unit 72, and the rotary brush 73 are disposed in the nozzle section 74. The belt 111 for linking the pulley 109 and intermediate pulley 110 of the blower 71, and the belt 112 for linking the intermediate pulley 110 and rotary brush 73 are disposed in the belt compartment 102. They transmit rotation of the blower 71. The filter 118 is provided opposite to the rotary brush compartment 78.

In an exhaust circulation loop for returning exhaust from the blower 71 to the brush compartment 78 through the filter unit 83 and filter 117, the exhaust is not discharged to outside of the unit from the nozzle section 74. Thus, the belt compartment 102 is utilized as a passage of the exhaust circulation, and the belts and pulleys are exposed to the exhaust. The exhaust prevents the belts and pulleys from dust, and prevents the compartment from invasion of dust from outside. The exhaust passage is confronting the rotary brush compartment 78 of the rotary brush 73. The filter 118 is provided to prevent the dust particles swept by the rotary brush 73 from invading. Since the belt compartment 102 is composed in the exhaust circulation passage, another exhaust circulation passage is not needed, and the dust collection box unit 72 is prevented from being installed incorrectly and becomes compact while maintaining its size and capacity.

This configuration provides a silent, environment-friendly, easy-to-use, and lightweight vacuum cleaner.

As shown in FIG. 17 to FIG. 19, and FIG. 28, the dust collection box unit 72 is disposed in the nozzle section 74, and is composed like drawer in a space enclosed by the upper unit 76 and window 105, or by the lower unit 77 and window 105.

The dust collection box unit 72 is composed like a drawer in the place enclosed by the upper unit 76 and window 105, or by the lower unit 77 and window 105. Therefore, this enclosed place is hardly moved by deviation of ribs or the like due to impact from the front side of the cleaner main body. That is, the upper side is reinforced with the window 105 formed in a member composed of the upper unit 76 or lower unit 77. The member, upon made of transparent material, allows a user to visually check the inside dust collection level in the dust collection box unit 72.

This configuration increases the strength of the nozzle section 74, and has the inside of the dust collection box unit 72 visible, thus providing an easy-to-use vacuum cleaner. As shown in FIG. 17 to FIG. 22, the dust collection box unit 72 is disposed in the nozzle section 74. The dust collection box unit 72 is composed like a drawer in a space enclosed by the upper unit 76 and window 105, or by the lower unit 77 and window 105.

The dust collection box unit 72 is composed like a drawer in the place enclosed by the upper unit 76 and window 105, or by the lower unit 77 and window 105. Therefore, this enclosed place is hardly moved by deviation of ribs or the like due to impact from the front side of the cleaner main body. That is, the upper side is reinforced by the window 105 in the member composed of the upper unit 76 or lower unit 77. One or more holes 106 in the window 105 make the inside of the dust collection box unit 72 visible from the top of the product, and allows the cleaner to be used more easily.

As shown in FIG. 17 to FIG. 19 and FIG. 29, the dust collection box unit 72 disposed in the nozzle section 74 is composed like a drawer in a space enclosed by the upper unit 76 and window 105, or by the lower unit 77 and window 105. Further, a hole 106 is formed in the overall width of the window 105, and a wall 107 is formed on the hole 106. The wall 107 is used as a second handle. The dust collection box unit 72, upon being made of transparent material, has its inside be visible.

In this configuration, the wall 107 surrounds the window 105, and the user can carry the cleaner main body by gripping the wall 107. The user, when cleaning stairs, for example, grips the wall 107 as a steering handle, thus using the cleaner more easily. Moreover, the dust collection box unit 72, upon being made of a transparent material, has its inside be visible, thus allowing the cleaner to be used easily.

As shown in FIG. 17 to FIG. 19 and FIG. 30, the dust collection box unit 72 is disposed in the nozzle section 74, and the dust collection box unit 72 is composed like a drawer in a space enclosed by the upper unit 76 and window 105, or by the lower unit 77 and window 105. Further at least one side wall 108 of the dust collection box unit 72 is tapered from the grip 97 toward the leading end 113, and the nozzle section 74 is similarly tapered.

In this configuration, the wall surrounded by the upper unit 76 and the window 105 or by the lower unit 77 and the window 105 is installed to the dust collection box unit 72 with having their tapers match to each other. A soft member of the filter unit 83, i.e., one of components of the dust collection box unit 72, is not rubbed against other parts although being always installed. The soft member contacts only when being fixed finally. This allows the dust collection box unit 72 to be mounted easily and to be thus used more easily.

As shown in FIG. 17 to FIG. 21, the dust collection box unit 72 is disposed in the nozzle section 74. The dust collection box unit 72 is composed like a drawer in a space enclosed by the upper unit 76 and window 105 or by the lower unit 77 and window 105. One or more ribs 114 are provided on the dust collection box unit 72, or on the upper unit 76 and window 105, or on the lower unit 77 and window 105, in parallel with the insertion direction of the upper side and lower side of the dust collection box unit 72.

In this configuration, in the space enclosed by the upper unit 76 and window 105 or by the lower unit 77 and window 105, the case of the dust collection box unit 72 does not fit face to face with the upper unit 76 and window 105 or with the lower unit 77 and window 105. The case contacts to the rib 114, so that the resistance is lowered. This provides a light-handling, flaw-resistant vacuum cleaner.

As shown in FIG. 17 to FIG. 21, the dust collection box unit 72 is disposed in the nozzle section 74. The dust collection box unit 72 is composed like a drawer in a space enclosed by the upper unit 76 and window 105 or by the lower unit 77 and window 105. The grip 97 is shaped along the appearance of the cleaner, and a protrusion 115 is provided in the lower part of the grip 97.

In this configuration, when the dust collection box unit 72 is drawn from the opening 116 by hooking the grip 97 with a finger, the protrusion 115 hits against the side of a hand. This prevents the hand from rubbing against the floor, thus providing an easy-to-use vacuum.

Figure 20:
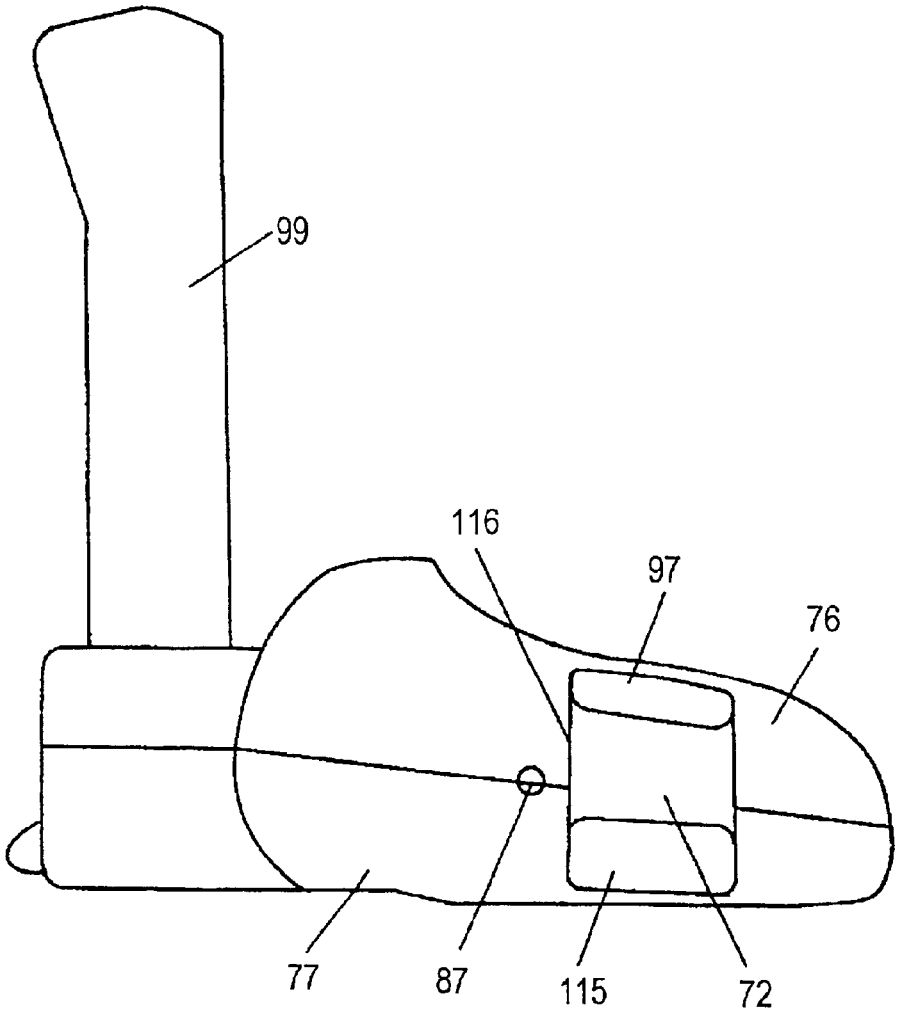
FIG. 20 is a side view of the vacuum cleaner.

As shown in FIG. 19 to FIG. 21, the dust collection box unit 72 is disposed in the nozzle section 74. The dust collection box unit 72 is composed like a drawer in a space enclosed by the upper unit 76 and window 105 or by the lower unit 77 and window 105. A safety device 87 is further provided near the opening 116.

In this configuration, if the rotary brush 73 is locked upon being caught by an end of carpet or the like, the safety device 87 operates. The safety device 87 can be reset manually. Thus, the user can reset through pressing a button of the safety device 87. The safety device 87 near the opening 116 allows operating parts handled by the user to concentrate in a place. This provides an easy-to-use vacuum cleaner.

According to the embodiment, the dust collection box unit 72 is composed of the dust collection box 82 and the filter unit 83 detachably fitted to the dust collection box 82. The box unit 72 is configured to flow in nearly parallel with the surface of the filter unit 83. As a result, dust particles are collected from the inner portion of the dust collection box unit 72. This allows the user to visually check the dust collection level, and thus allows the cleaner to be used easily.

Further, the dust collection box unit 72 is composed of the dust collection box 82 and the filter unit 83 detachably fitted to the dust collection box main body 82. The suction passage 80 is formed from one end to other end of the dust collection box unit 72. This makes dust particles collected from the inner portion of the dust collection box unit 72, thus allowing the user to visually check the dust collection level, and allowing the cleaner to be used easily.

Further, the dust collection box unit 72 is composed of the dust collection box 82 and the filter unit 83 detachably fitted to the dust collection box 82. The suction passage 80 is formed integrally with the dust collection box 82. This reduces the number of parts, and further, provides the cleaner with a stable performance free from air leak.

Further, the dust collection box unit 72 is composed of the dust collection box 82 and the filter unit 83 detachably fitted to the box 82. The dust collection box 82 of the dust collection box unit 72 is nearly rectangular parallelepiped. The four corners of the recess 94 of the nozzle section 74 for mounting the dust collection box unit 72 are shaped identically with the four corners corresponding to the dust collection box main body 82. This allows the dust collection box unit 72 to be installed in the nozzle 74 only in one direction.

The dust collection box unit 72 is composed of the dust collection box 82 and the filter unit 83 detachably fitted to the dust collection box 82. The intake port 95 of the dust collection box 82 and the intake port 98 of the blower 71 are provided diagonally nearly in the width direction of the nozzle section 74. This makes dust particles are collected from the inner portion of the dust collection box unit 72, thus allowing the user to visually check the dust collection level, and providing an easy-to-use cleaner.

The dust collection box unit 72 is composed of the dust collection box 82 and the filter unit 83 detachably fitted to the dust collection box 82. The intake port 95 of the dust collection box unit 72 and the dust collection port 79 of the nozzle section 74 are tightly fixed with the bump 138 provided in the dust collection box 82. This reduces the number of parts, and makes the dust suction performance stable.

The dust collection box unit 72 is composed of the dust collection box 82 and the filter unit 83 detachably fitted to the dust collection box main body 82. In order to install the dust collection box unit 72 in the recess 94 of the nozzle section 74, the ratchet 137 for holding the nozzle section 74 and dust collection box unit 72 is provided outside of the recess 94 of the nozzle section 74. This allows the dust collection box unit 72 to be securely fixed and held, thus enhancing the quality.

Further, the blower 71, rotary brush 73, and dust collection box unit 72 are disposed in the nozzle section 74. The dust collection box unit 72 is composed of the dust collection box 82 and the filter unit 83 detachably fitted to the dust collection box 82. The grip 97 of the dust collection box 82 is attached at the opposite side of the belts 111, 112 for linking the blower 71 and rotary brush 73. This maintains the dust collecting capacity without sacrificing the appearance.

Further, the dust collection box unit 72 is composed of the dust collection box 82 and the filter unit 83 detachably fitted to the dust collection box 82. The dust collection box unit 72 is disposed in the nozzle section 74, and the window 105 is formed on the top of the nozzle section 74 so as to cover the dust collection box unit 72. The dust collection box unit 72 is composed like a drawer in a space enclosed by the window 105 and the lower unit 77 or by the upper unit 76. As a result, the upper unit 76 can be reinforced by the window 105, and the strength can be increased.

Further, the dust collection box unit 72 is composed of the dust collection box 82 and the filter unit 83 detachably fitted to the dust collection box 82. The dust collection box unit 72 is disposed in the nozzle section 74, and the window 105 is formed on the top of the nozzle section 74 so as to cover the dust collection box unit 72. One or more holes 106 are provided in the window 105, and the dust collection box unit 72 is composed like a drawer in a space enclosed by the window 105 and the lower unit 77 or by the window 105 and the upper unit 76. This allows the dust collection level on the dust collection box unit 72 to be visually checked, and enhances the ease of use.

Further, the dust collection box unit 72 is composed of the dust collection box 82 and the filter unit 83 detachably fitted to the dust collection box 82. The dust collection box unit 72 is disposed in the nozzle section 74, and the window 105 is formed on the top of the nozzle section 74 so as to cover the dust collection box unit 72. A hole 106 is formed in the window 105 almost in the overall width of the dust collection box 82, and a wall 107 is formed on the hole 106 from the front part of the nozzle section 74 toward the center of the hole 106. As a result, the dust collection level can be checked through the window 105, and a second grip is formed in the window, so that the ease of use may be enhanced.

Moreover, the blower 71, the dust collection box unit 72, and the rotary brush 73 are disposed in the nozzle section 74. The dust collection box unit 72 is disposed to be drawn out freely from the opening 116 at the side of the nozzle section 74. The box unit at least one side is tapered at least one side from the grip 97 of the dust collection box unit 72 toward the leading end, and a similar taper is formed in the mounting portion in the nozzle opening. This allows the dust collection box unit 72 to be mounted to the nozzle section 74 more easily.

The dust collection box unit 72 is disposed to be drawn out freely from the opening 116 at the side of the nozzle section 74. One or more ribs 114 are provided on the top of the dust collection box unit 72, the window 105, a lower side of the dust collection box unit 72, or provided along the mounting direction from the lower unit 77 to the dust collection box unit 72. This allows the dust collection box unit 72 to be mounted to the nozzle section 74 more easily.

The dust collection box unit 72 is disposed to be drawn out freely from the opening 116 at the side of the nozzle section 74. The grip 97 is shaped along the appearance, and a step 115 which does not project from the appearance of the nozzle section 74 is provided in the lower part of the grip 97. As a result, even if gripping the grip, a hand is prevented from rubbing against a floor, so that the ease of use may be enhanced.

The dust collection box unit 72 is disposed to be drawn out freely from the opening 116 at the side of the nozzle section 74. The safety device 87 is provided at a grip 97 side of the dust collection box unit 72, so that the ease of use may be enhanced.

Further, in the configuration that the blower 71, rotary brush 73, and dust collection box unit 72 are disposed in the nozzle section 74, the dust collection box unit 72 is installed in the recess 94 of the nozzle section 74. A passage for sending exhaust from the blower 71 into the rotary brush compartment 78 is provided in the recess 94. And the dust collection box unit 72 is specified in direction, so that the dust collection box unit 72 can be installed in the nozzle section 74 only in one direction.

(Embodiment 3)

Figure 31:
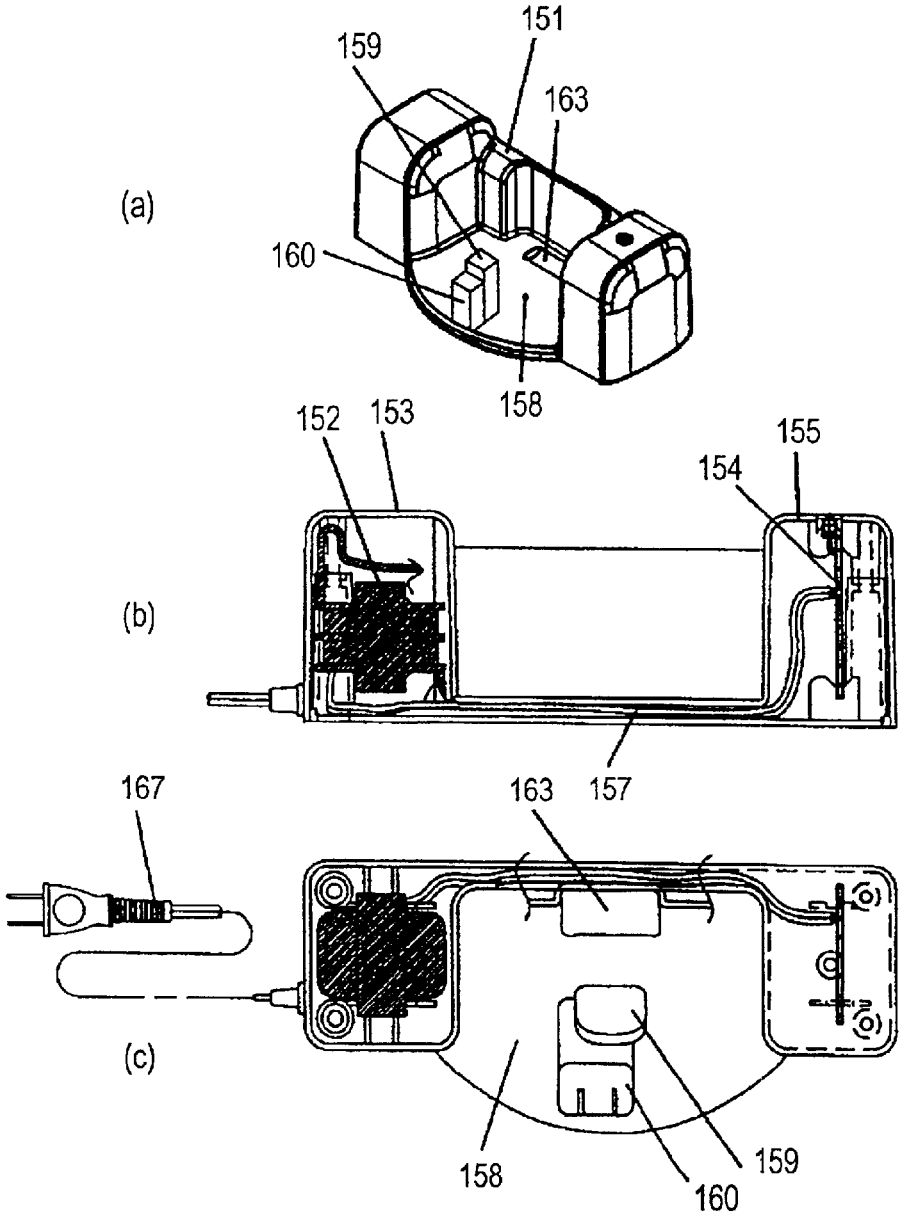
FIG. 31(*a*) is a perspective view of a charger of a vacuum cleaner according to embodiment 3 of the invention.
Figure 32:
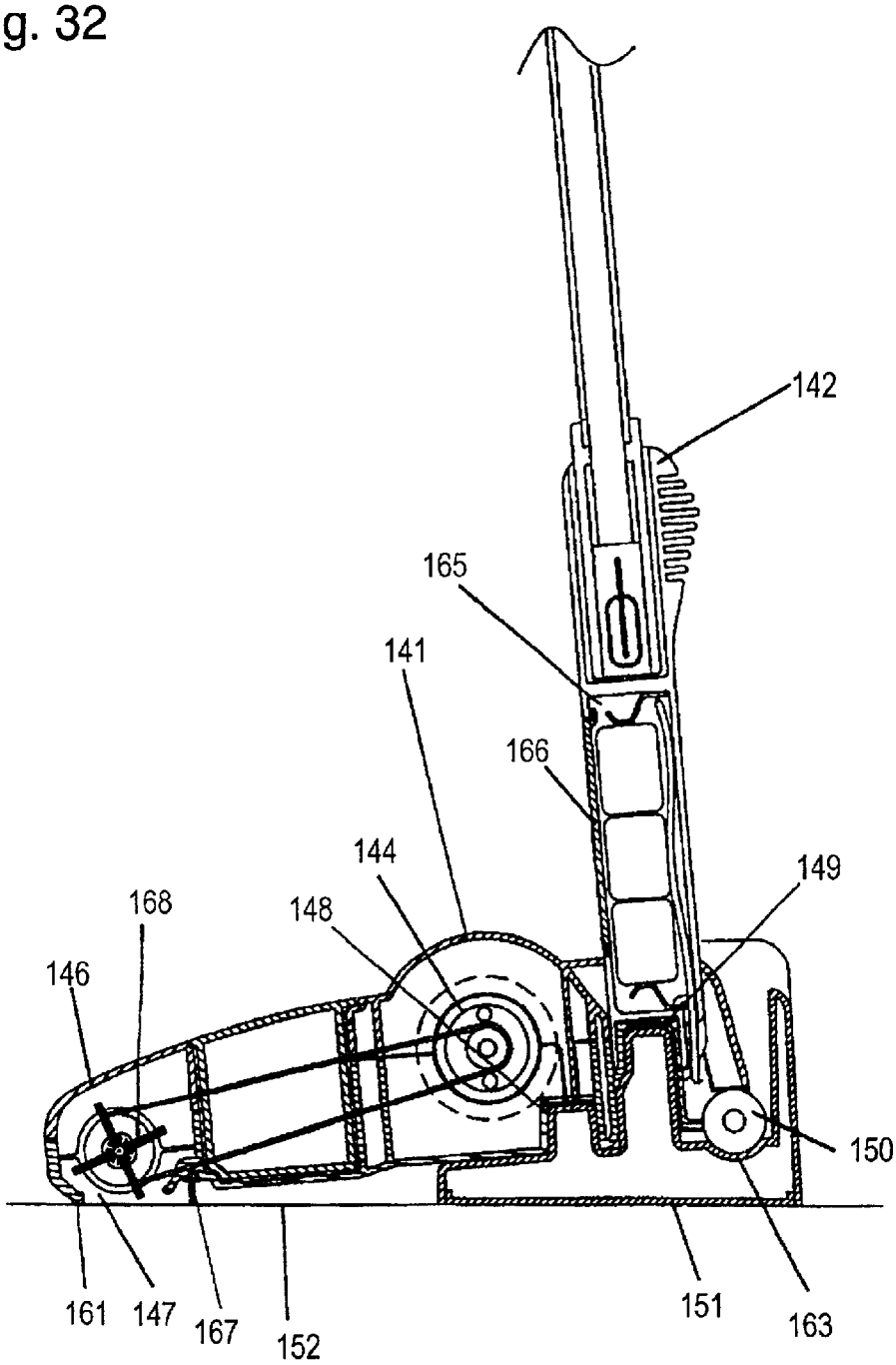
FIG. 32 is a side sectional view having a cleaner main body accommodated in the charger of the vacuum cleaner.
Figure 33:
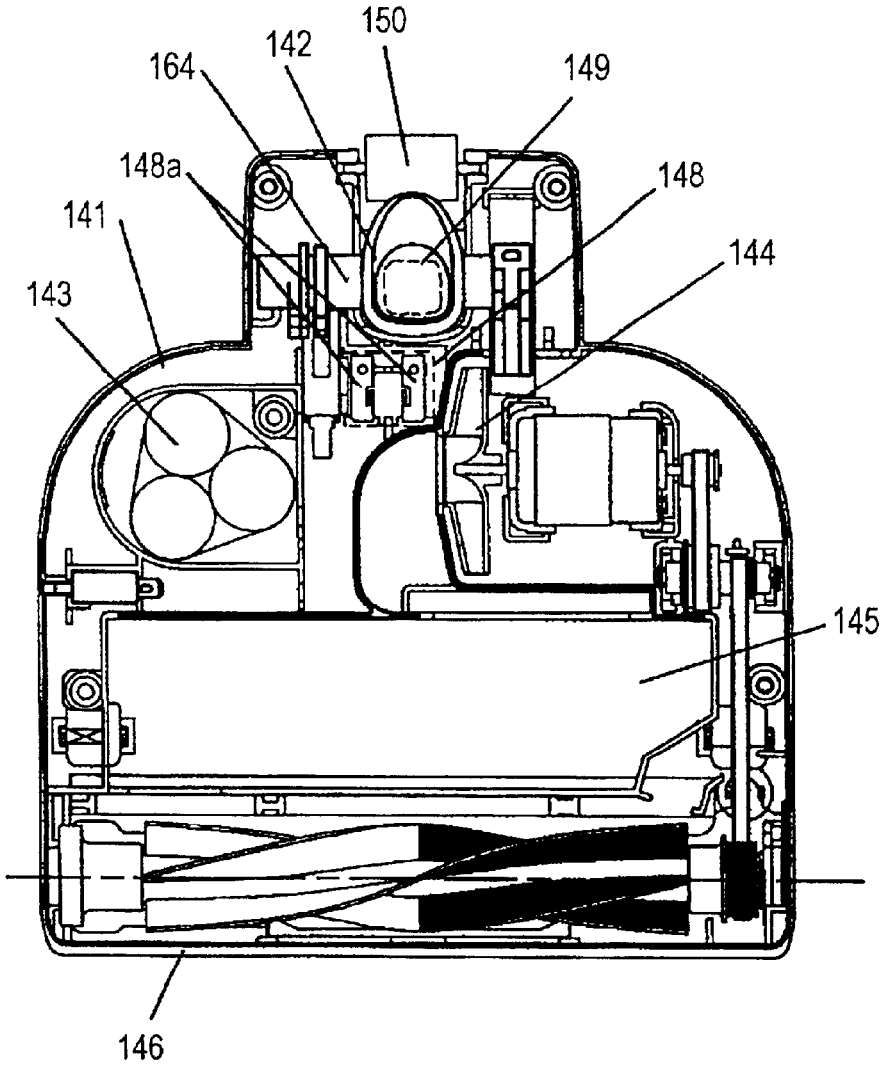
FIG. 33 is a horizontal sectional view of the cleaner main body of the vacuum cleaner.
Figure 34:
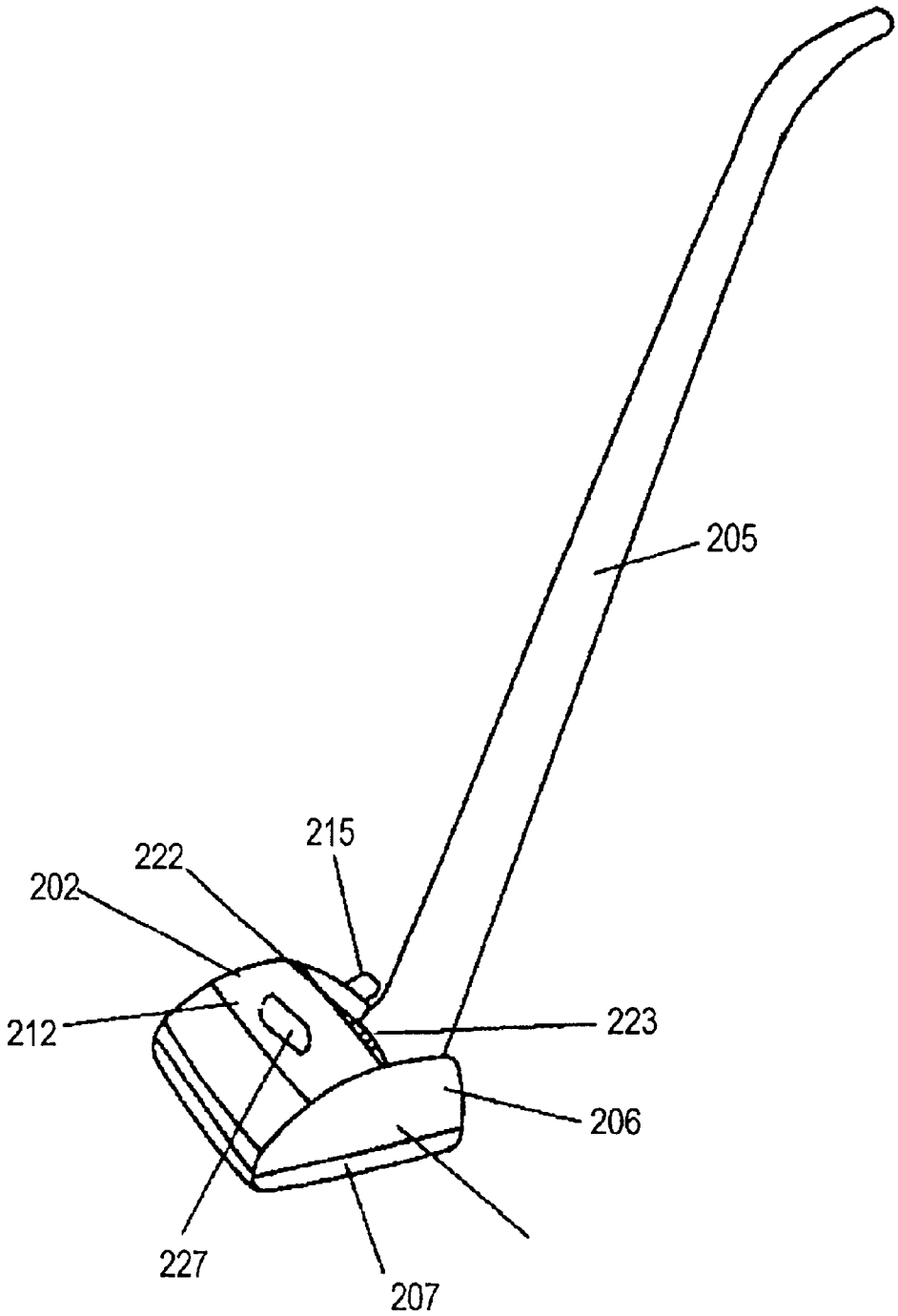
FIG. 34 is a perspective view of a conventional vacuum cleaner.
Figure 35:
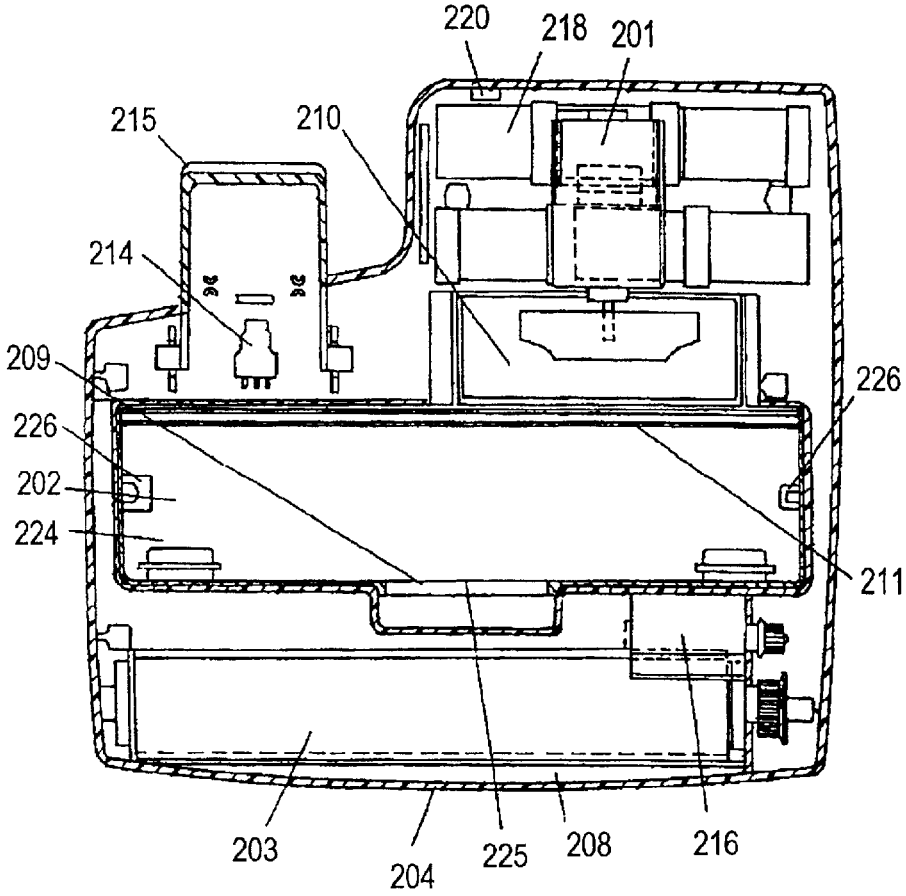
FIG. 35 is a horizontal cross sectional view of the vacuum cleaner.
Figure 36:
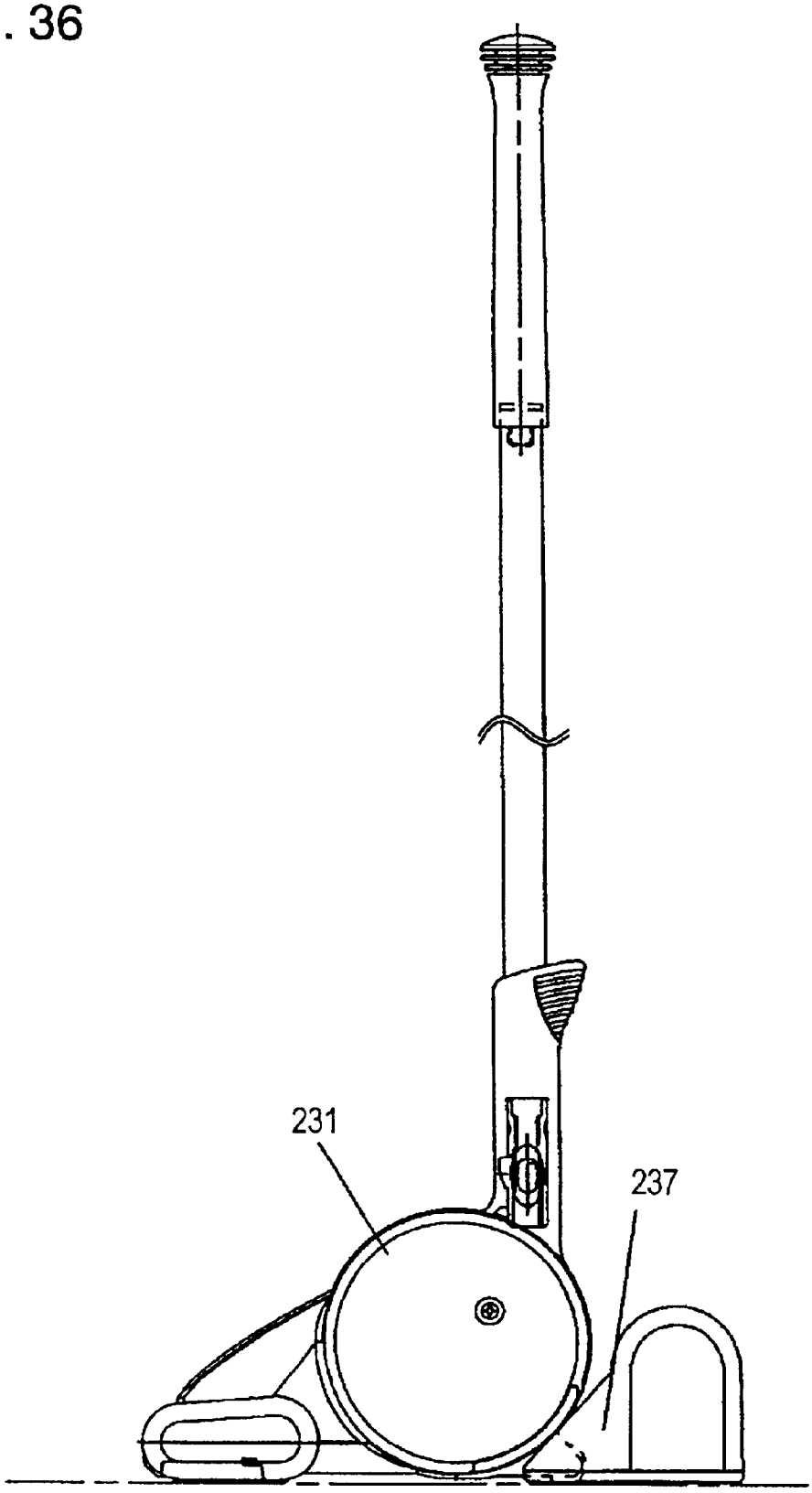
FIG. 36 is a side view of another conventional cleaner accommodating a cleaner main body and a charger.
Figure 37:
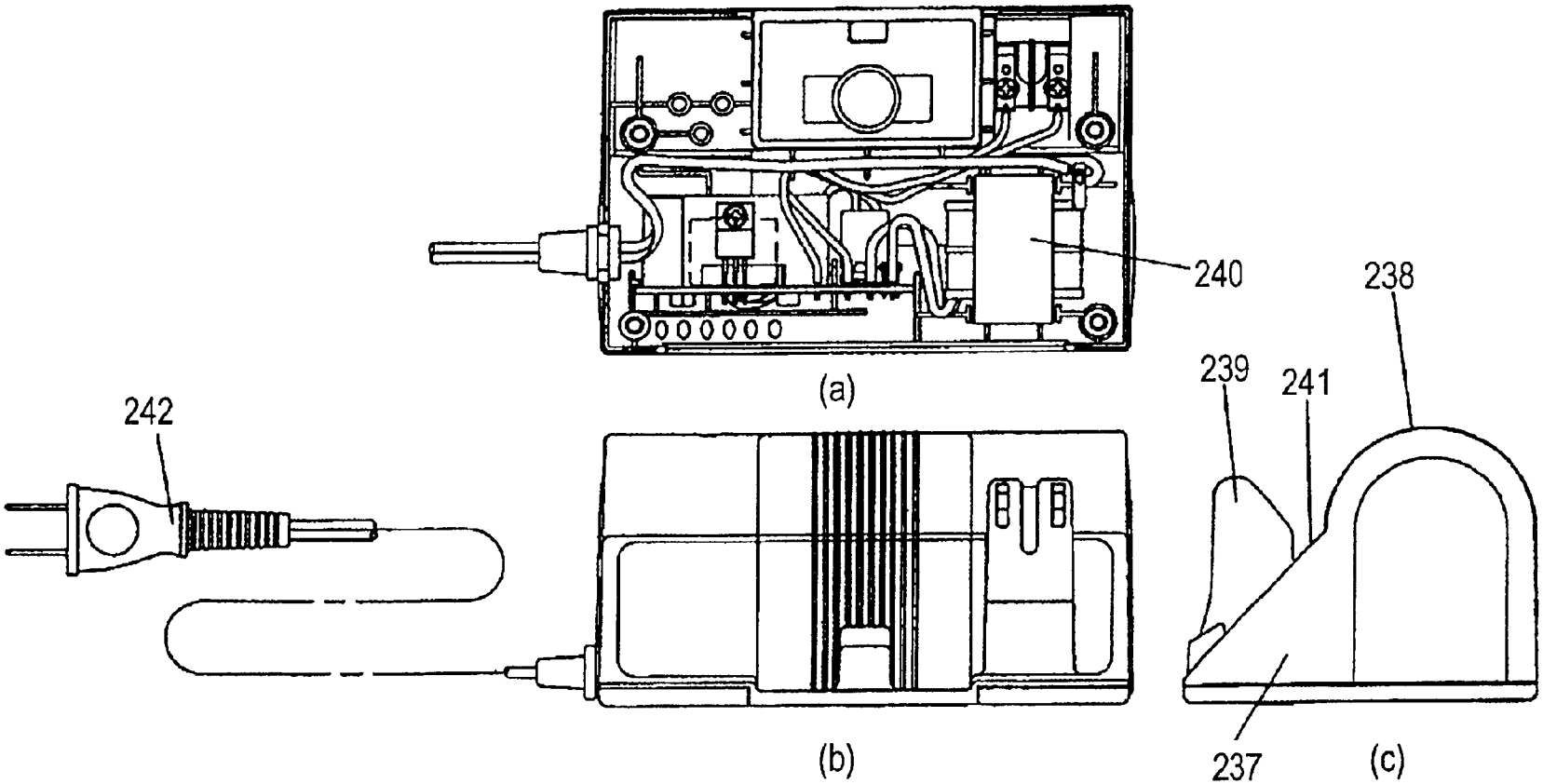
FIG. 37(*a*) is a cross sectional view of the charger of the vacuum cleaner.
Figure 38:
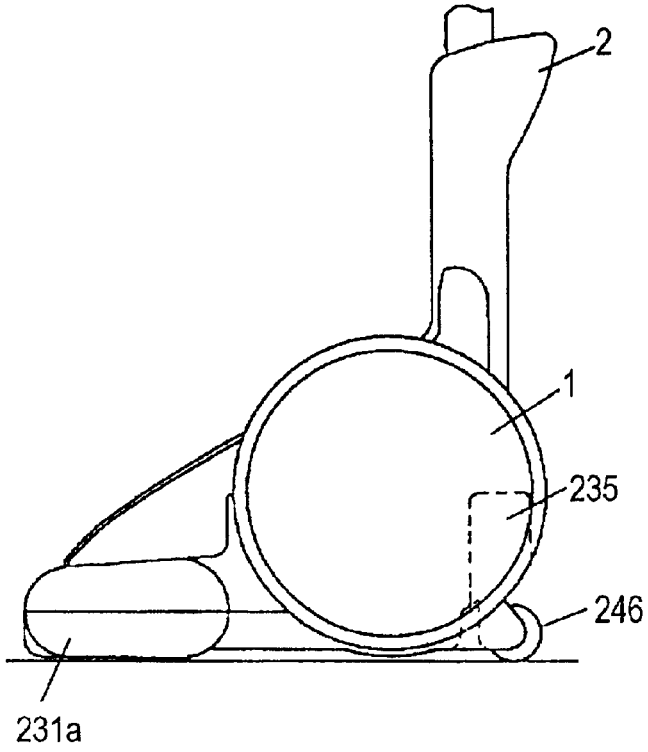
FIG. 38(*a*) is a side view of the cleaner main body of the vacuum cleaner.
Figure 38:
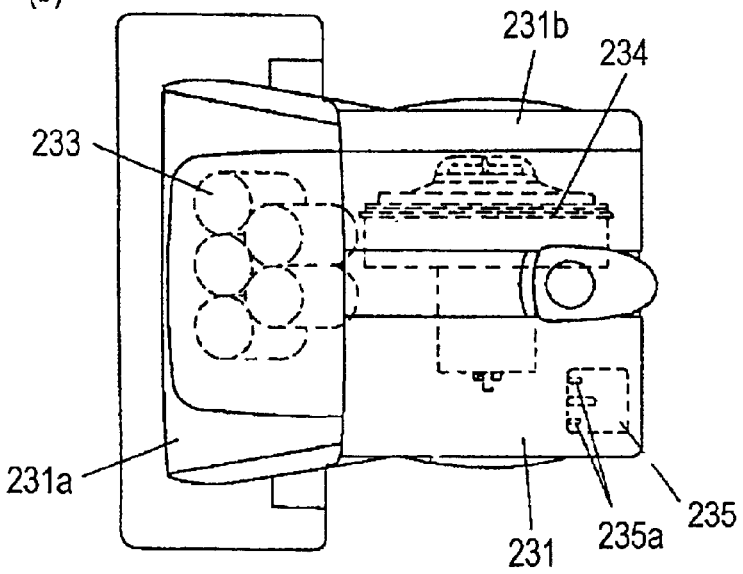

Referring to the drawings, embodiment 3 of the invention will be explained. As shown in FIG. 31 to FIG. 33, a cleaner main body 141 has a handle 142 for operation disposed tiltably on its top. Behind the cleaner main body 141, a blower 144 is disposed, and a dust collection unit 145 is provided at the suction side of the blower 144. A suction unit 146 is provided ahead of the cleaner main body 141, and a suction port 147 for introducing dust particles on a surface to be cleaned into the suction unit 146 is provided at the lower side of it. The suction unit 146 and dust collection unit 145 are communicated with a passage, and a battery 143 is disposed behind the suction unit 146. Further, at the lower side behind the cleaner main body 141, a charger terminal connection unit 148 and a hole 149 are disposed. The charger terminal connection unit 148 is disposed in an outer space in the front part of the blower 144, away from the center of the cleaner main body 141. The charger terminal connection unit 148 has a concave shape getting into the outer space of the blower 144 from the lower side, and a terminal 148*a* is provided in this concave wall. At the rear end of the cleaner main body 141, a traveling roller 150 is provided in a form of projecting from the lower side and rear side of the cleaner main body 141.

A charger 151 is separated into a left box 153 for accommodating a power transformer 152 and a right box 155 for accommodating a printed circuit board 154, which are coupled by a flat coupling plane 158 to be formed nearly in a squared U-shape. Inside of the coupling plane 158, lead wires 157 are disposed, while a bump 159 to be inserted into the hole 149 of the cleaner main body 141 is provided on the top of the coupling plane 158. The bump 159 of the coupling plane 158 fits into the hole 149 of the cleaner main body 141. The charger terminal connection unit 148 and charger terminal 160 are connected. As the hole 149 and bump 159 fit together, the cleaner main body 141 is securely held at a specified position of the charger 151. The top of the coupling plane 158 on which the cleaner main body 141 is mounted is formed in a slope. When the cleaner main body 141 is mounted, the forward bottom 161 of the cleaner main body 141 may contact with the floor 162. On the top of the coupling plane 158, a recess 163 is provided for installing the roller 150 of the cleaner main body 141. A power wire 157 is inserted into an ordinary wall outlet. The battery is accommodated in the operation handle 142 tiltably provided through the rotary shaft 164. Specifically, the battery is accommodating in a space 165 with a lid 166 for opening the space from the case. This allows the battery 143 to be installed and removed easily.

This configuration is composed of the cleaner main body 141 accommodating the blower 144 and including the charger terminal connection unit 148, and the charger 151 having the charger terminal 160 connected to the charger terminal connection unit 148 of the cleaner main body 141. The charger 151 is separated into the left box 153 for accommodating the power transformer 152 and the right box 155 for accommodating the printed circuit board 154. The cleaner main body 141 is mounted on the coupling plane 158 including the charger terminal unit 160. The charger 151 is formed nearly in a squared U-shape. Therefore, the coupling planes 158 of the left box 153 and right box 155 are composed in parallel with each other, and the dimension of the cleaner main body 141 projecting from the charger 151 (a floor contact dimension) can be decreased. This can reduce the space of installing the cleaner main body 141 in the charger 151.

Moreover, the charger 151 is formed like the squared U-shape having the left box 153 and right box 155 projecting upward from both sides of the coupling plane 158. Therefore, when the cleaner main body 141 is mounted on the coupling plane 158, respective walls of both boxes function as guides for inserting the cleaner main body 141, so that the ease of use is further enhanced.

Further, a slope on the coupling plane 158 including the charger terminal unit 160 has the forward bottom 161 of the cleaner main body 141 touch on the floor 162 when installing the cleaner main body 141. Therefore, in addition to with the coupling plane 158, the cleaner main body 141 has the forward bottom 161 supported with the floor 162. This increases a supporting area for the cleaner main body 141 upon being stored, thus being installed stably.

The forward bottom 161 of the cleaner main body 141 abut by force forms a space cleared from the floor 162 behind. The space avoides the contact between the floor 162 and a lip 167 for sweeping made of soft material provided behind the forward bottom 161 (behind the rotary brush in the suction unit)of the cleaner main body 141. This prevents the lip 167 from deformation due to contact.

In the conventional configuration, when the cleaner main body 141 is put in the charger 151, dust particles sticking to the rotary brush 168 often fall and gather in the coupling plane 158 of the charger 151. But in this configuration, the dust particles falling on the coupling plane 158 do not stay on the coupling plane 158 because the coupling plane 158 is sloped, but slide on the floor 162. The falling dust particles can be easily sucked up through detaching the cleaner main body 141 from the charger 151.

Further, the recess 153 is provided for installing the roller 150 of the cleaner main body 141 in the coupling plane 158 forming the charger terminal unit 160. This allows the charger 151 to be fixed more securely to the cleaner main body 141.

The battery 143, since being provided in the cleaner main body 141, lowers the center of gravity of the cleaner main body 141. And the structure having the left box 153, the right box 155, and the coupling plane 158 in a squared U-shape coupling the left box 153 and right box 155 allows the main body to be stored stably.

The battery 143, upon being provided in the handle 142 for operation tiltably provided on the top of the cleaner main body 141, does not require its storing space in the cleaner main body 141. This reduces the case shape and the size, and thus reduces the overall size during a charging including the charger 151.

Thus, according to the embodiment, the cleaner includes the cleaner main body 141 having the charger terminal connection unit 148, and the charger 151 composed of the separated boxes. The charger terminal unit 160 is provided in the coupling plane 158 for coupling the boxes, and the cleaner main body 141 is mounted on the coupling plane 158. Therefore, their layout is parallel instead of the tandem layout in the prior art. Overlaying of the cleaner main body 141 on charger 151upon being stored reduces the floor contact area, deletes obstacle when being stored, and enhances the convenience of use.

The chargeable vacuum cleaner incorporating the blower 144 has been explained, but the same effects are also obtained in a chargeable floor polishing cleaner without the incorporated blower 144.

INDUSTRIAL APPLICABILITY

The invention presents a vacuum cleaner which can be repaired easily, inform a dust collection level visually, and be charged and stored while saving a space, so that the convenience for the user is outstandingly improved.

What is claimed is:

1. A vacuum cleaner comprising:

a blower;

a rotary brush for sweeping a dust particle;

a belt for transmitting a driving force from said blower or other motor to said rotary brush; and a belt compartment accommodating said belt, being used as an exhaust passage for passing exhaust from said blower.

2. A vacuum cleaner comprising a nozzle section;

a handle coupled to said nozzle section;

a blower;

a dust collection box unit, said, blower and said dust collection box unit being working elements; and a rotary brush for sweeping a dust particle, being accommodated in said nozzle section, wherein said dust collection unit is detachably disposed at an opening provided at a side of said nozzle section.

3. The vacuum cleaner of claim 2, wherein said nozzle section includes a case including a lower unit and an upper unit, wherein said dust collection box unit includes:

a dust collection box; and a filter unit detachably fitting to said dust collection box;

wherein a window is formed on a top of said nozzle section for covering said dust collection box unit; and wherein said dust collection box unit is inserted in a space enclosed by said window and said lower unit or by said window and said upper unit.

4. A vacuum cleaner comprising:

a nozzle section crawling on a floor;

a blower;

a rotary brush for sweeping a dust particle;

a dust collection unit including:

a dust collection box; and a filter unit detachably fitting to said dust collection box;

a belt for transmitting rotation of said blower to said rotary brush, being disposed in said nozzle section; and a grip provided at a side of said dust collection box, said side being opposite to said belt.

5. A vacuum cleaner comprising:

a nozzle section crawling on a floor;

a blower;

a rotary brush for sweeping a dust particle;

a dust collection box unit including:

a dust collection box having a grip at a side thereof; and a filter unit detachably fitting to said dust collection box; and a belt for transmitting rotation of said blower to said rotary brush, being disposed in said nozzle section, wherein said dust collection box unit is freely drawn out of and put in an opening provided at a side of said nozzle section, and wherein said grip of said dust collection box is shaped along an appearance shape.

6. A vacuum cleaner comprising:

a cleaner main body including a charge terminal connection unit; and a charger including:

separate boxes;

a coupling plane coupling said separate boxes;

a charger terminal unit provided on said coupling plane, wherein said cleaner main body is mounted on said coupling plane;

a power source transformer disposed in one of said separate boxes; and a printed circuit board disposed in another of said separate boxes.

7. The vacuum cleaner of claim 6, wherein a forward bottom of said cleaner main body touches down on a floor when said cleaner main body is mounted on said charger.

* * * * *